US006231311B1

(12) United States Patent
Gatley et al.

(10) Patent No.: US 6,231,311 B1
(45) Date of Patent: May 15, 2001

(54) METHOD AND APPARATUS FOR PROVIDING DILUTION AIR TO A BLOWER MOTOR

(75) Inventors: William S. Gatley, Cassville; Dale Stewart, Aurora, both of MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

(21) Appl. No.: 09/398,484

(22) Filed: Sep. 17, 1999

(51) Int. Cl.[7] ..... F04B 19/24; F04B 17/00; F22B 5/00

(52) U.S. Cl. ..... 417/53; 417/366; 122/17

(58) Field of Search ..... 417/53, 366, 372; 415/3; 236/10; 126/45, 116, 312; 122/17, 14.01, 44, 13.1; 110/147

(56) References Cited

U.S. PATENT DOCUMENTS

| | | | | |
|---|---|---|---|---|
| 2,188,741 | * | 1/1940 | Roberts | 98/72 |
| 3,777,975 | * | 12/1973 | Kofink | 237/12.3 A |
| 4,225,292 | * | 9/1980 | Hallerback et al. | 417/367 |
| 4,475,868 | * | 10/1984 | Renger | 415/225 |
| 4,799,855 | * | 1/1989 | Milocco et al. | 415/143 |
| 5,277,232 | * | 1/1994 | Borsheim | 141/65 |
| 5,352,099 | * | 10/1994 | Anstine et al. | 417/366 |
| 5,375,651 | * | 12/1994 | Colwell | 165/47 |
| 5,385,444 | * | 1/1995 | Kobayashi et al. | 415/182.1 |

* cited by examiner

*Primary Examiner*—Teresa Walberg
*Assistant Examiner*—Daniel Robinson

(57) ABSTRACT

A blower is disclosed which has a housing that provides a means for drawing dilution air into a combined motor and impeller housing. The dilution air is drawn into a first chamber which houses the blower motor and is then drawn into the impeller chamber where the dilution air mixes with hot exhaust gases from a hot water heater to which the blower is attached. Apertures on a back plate of the impeller provide fluid communication between the motor chamber and the impeller chamber. The housing has walls which extend beyond a housing cover to form a skirt so that the attachment of the blower to a water heater top results in a third chamber being formed within which the water heat flue is situated.

The combination of the skirt section, the housing cover and the top of the hot water heater comprise the third chamber which has at least one slot provided therein for drawing dilution air into the third chamber where the dilution air is mixed with the exhaust gases exiting the water heater flue. The mixed air and exhaust gas is drawn into the second chamber by the operating impeller where the mixture is further mixed with the dilution air drawn from the motor chamber into the housing. The mixed gases are then channeled out an outlet port formed in the blower housing.

The invention eliminates the need for fans dedicated to cool the blower motor while providing the means for more effectively reducing the temperatures of the exhaust gases which exit the blower.

33 Claims, 23 Drawing Sheets

METHOD AND APPARATUS FOR PROVIDING DILUTION AIR TO A BLOWER MOTOR

BACKGROUND OF THE INVENTION

1. Field of the Invention

This invention relates generally to draft inducers for hot water heaters. More particularly, the present invention relates to blower designs for cooling electric motors placed inside blower housings.

2. Description of Related Art

Typical blower housing and motor assemblies, particularly with respect to centrifugal fans having radial-flow impellers, are configured with the motor being attached to an end of a circular or scroll-shaped blower housing. The motor's shaft extends axially into the housing where an impeller, confined by the blower housing, is attached to the motor shaft. The blower housing typically has one inlet and one outlet. Combustion gases are drawn into the housing by the rotating impeller which expels the gases through the outlet into a flue or similar avenue of exit.

With respect to motor cooling, the gases that are forcibly moved through the housing by the impeller do not come into contact with the motor. Thus, blower activity does not in any way contribute to the cooling of the motor.

Due to the inevitable generation of heat by an operating motor, a means for cooling the motor during operation is needed. Conventional blower/motor assemblies have one or two auxiliary fans attached to the rotor to draw motor-cooling air into the motor housing. Vents are provided in the motor housing to enable air infiltration. The incoming air is channeled around the motor windings and out the same vents.

Another approach for providing cooling air to a blower motor is described in U.S. Pat. No. 5,352,099 to Anstine et al. In the '099 patent, a blower having an optional one-piece motor/impeller housing with a cover is suspended above the flue pipe of a water heater with brackets. The inlet of the blower housing is situated in axial alignment with the water heater exhaust flue. Vents situated in the motor portion of the blower housing allow cooling air to be drawn over the motor and expelled out an outlet through which the exhaust gases drawn into the blower are also expelled.

This approach to introducing cooling air into the blower has numerous problems which effect both the overall efficiency of the blower and the ability to effectively cool the motor. By having the blower housing suspended over the flue pipe, it is very difficult to establish the negative pressure necessary to draw in the flue gases for expulsion from the water heater. The lack of negative pressure results from the lack of a containment area or enclosure that enables the rotating impeller to generate the necessary negative pressure.

An additional problem encountered with the '099 patent design is the inability to control standby losses when there is no demand placed on the water heater. With the flue open to the atmosphere, i.e, below the blower, absent blower activity, flue gases and heat generated during standby cannot be controlled.

A further problem is the inability to control the dilution air flow. The "open" concept of the '099 patent suspended blower design prevents any appreciable control over the flow of dilution air other than by altering the rotational velocity of the impeller. Altering impeller velocity, however, can have a negative effect on efficiency.

Although numerous blower housing designs have been developed to address motor cooling, none to date have the capability to provide a controlled amount of cooling air to the blower motor without the need for auxiliary fans attached to the motor. None have devised a blower housing that is easy and cost-effective to manufacture such that the dilution air flow can be controlled to balance the need for exhaust gas expulsion and the need for motor cooling. None have devised a blower housing that can accomplish these tasks as well as provide ease of assembly and disassembly for maintenance purposes. A way to provide all these advantages has now been developed.

It is, therefore, an object of the present invention to provide a blower housing assembly that reduces the number of components necessary to provide a functioning blower. The need for separate motor and impeller housing is obviated.

Another object of the present invention is to provide a blower housing that allows the negative pressure generated by a rotating impeller to draw cooling or dilution air into the motor chamber to cool the motor.

An additional object of the present invention is to provide a blower housing with a skirt extending past a blower housing cover for attachment to the top of a hot water heater to facilitate and maximize the potential to draw exhaust gases out of and away from the hot water heater.

A further object of the present invention is to provide a blower housing design that allows for the control of dilution air added to the exhaust gases emanating from a hot water heater to reduce the overall temperature of the mixed gases to an acceptable level.

A still further object of the present invention is to provide a cost-effective blower housing that is easy to manufacture and requires no additional parts beyond a housing body and a housing cover. These and other objects of the invention will be made apparent from a review of the drawings and a reading of the following summary and detailed description of the invention.

SUMMARY OF THE INVENTION

The blower housing assembly described herein includes a blower housing that confines both a motor and impeller in one continuous unit. In one embodiment, the blower housing is formed with apertures to receive the inlet and outlet water pipes of a hot water heater. In a second embodiment, the blower housing is sized to fit between the pipes.

The one-piece blower housing has a first chamber for receiving a motor and a second chamber for receiving an impeller. The first and second chambers are in fluid communication. The first chamber has at least one vent slot provided therein to provide ingress for dilution air. The slot is situated on a top surface of the first chamber but may be situated in a circumferential wall of the chamber.

The impeller is fixed to a motor shaft attached to a rotor of the motor. The impeller has a backplate with apertures. The apertures place the first chamber and second chamber in fluid communication. Negative pressure generated in the second chamber by rotation of the impeller causes air to be drawn into the second chamber from the first chamber which, in turn, creates a negative pressure in the first chamber. The negative pressure in the first chamber draws cooling air into the first chamber via the at least one vent slot.

The blower housing has portions which define an outlet. The outlet is formed so that it is in fluid communication with the second chamber. The outlet provides egress for exhaust gases emanating from a hot water heater to which the blower is designed to be attached.

A blower housing cover is provided which is attached to the blower housing at an intermediate location along a side wall of the blower housing. The blower housing cover has portions which define an inlet aperture to allow air and/or exhaust gases from a hot water heater to enter the second chamber.

The housing side wall extends beyond the cover and forms a skirt. At least one skirt vent slot is provided in the skirt. The skirt has portions adapted for securing the blower housing to the top of a hot water heater. The combination of the skirt, the blower housing cover and the top of the water heater form a third chamber within which a flue pipe of the hot water heater is confined.

The third chamber enables and facilitates the control of dilution air entering the at least one skirt vent slot. These and other objects and features of the present invention will be apparent from a review of the drawings and a reading of the following detailed description of the invention.

DESCRIPTION OF THE INVENTION

Figure 1:
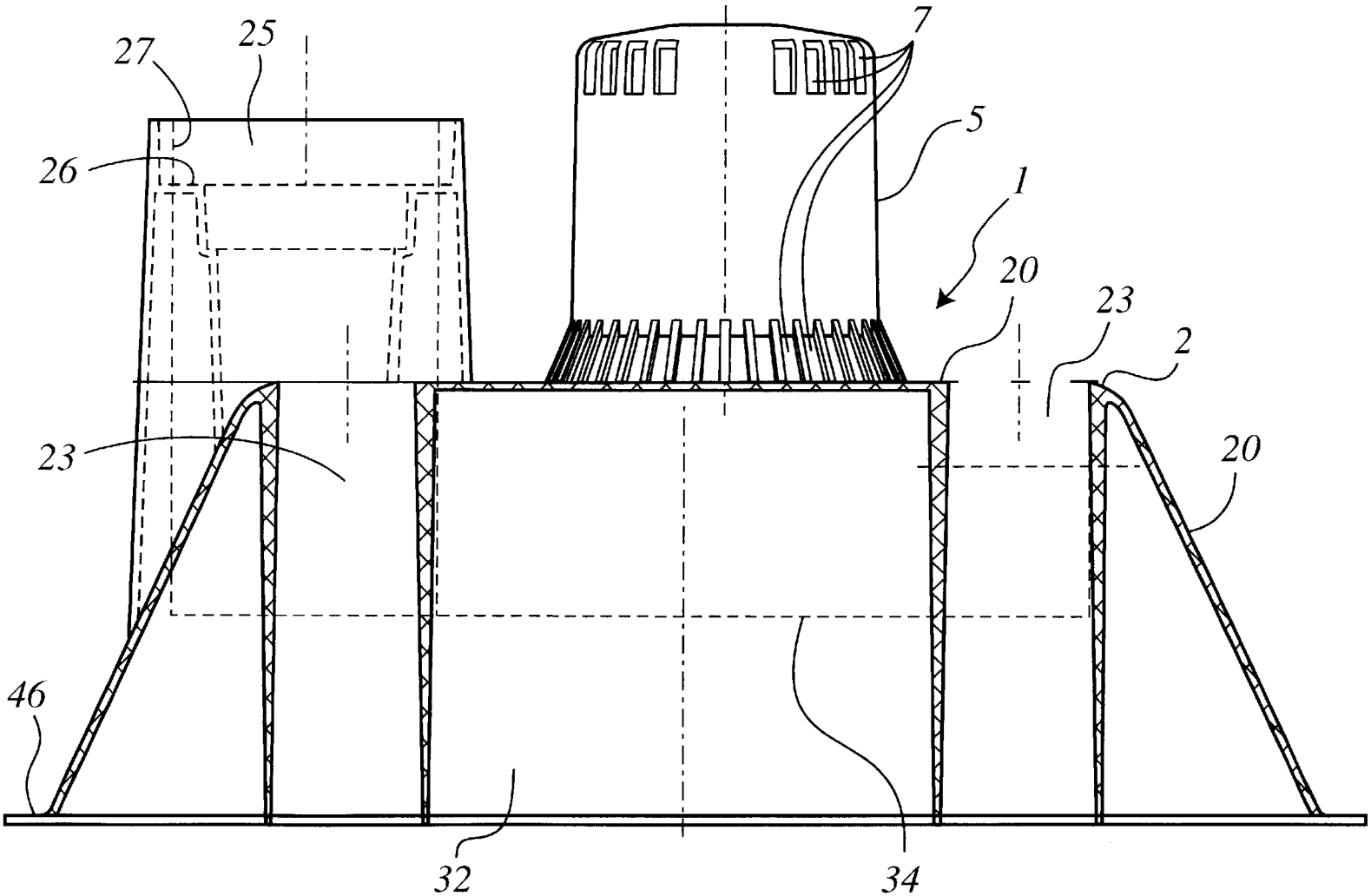
FIG. 1 is a side elevational view of a dilution air blower housing in accordance with one embodiment of the invention.

At the outset, the invention is described in its broadest overall aspects with a more detailed description following. A high efficiency water heater typically includes a combustion air inlet, a combustion chamber, a heat recovery section, a draft inducer and a combustion gas exhaust. When the water heater is in operation, the draft inducer or combustion blower creates a negative pressure or induces a draft in the water heater so air for combustion is drawn into the air inlet and then into the combustion chamber, where the air is mixed with a fuel such as natural gas for combustion or burning (i.e., the heat energy source). The heat energy of the combustion process is then extracted from the combustion or exhaust gases in the heat recovery section which also results in a reduction in the temperature of the combustion gases. For high efficiency water heaters, heat recovery is generally accomplished in two stages.

After passing through the heat recovery section of the water heater, the relatively cooler combustion gases are drawn into the draft inducer or combustion blower by the rotation of the impeller or rotating blades within the draft inducer. The rotation of the impeller or rotating blades of the blower creates the draft which draws the air for combustion into the hot water heater and which draws the combustion gases through the water heater and the heat recovery sections. The combustion gases are then exhausted by the draft inducer through an exhaust pipe out to the atmosphere.

To provide an even, efficient flow of gases, it is important that the housing for the draft inducer by adequately sealed so that gases are drawn into the inducer at an inlet and expelled at an outlet. Any leaks in the housing will inevitably lead to the inefficient and incomplete removal of combustion gases.

Equally important is a means to cool the blower motor during operation. Typically, the blower motor is provided with one or two auxiliary fans that are dedicated to draw air into the motor housing to cool down the motor during operation. The air drawn into the motor housing of a conventional blower does not mix with the combustion gases or use the same exhaust port. Instead, the air used to cool the motor is worked out of the motor housing via vents.

To accomplish all of these functions as well as others, a new blower housing construction has been devised wherein a single housing and cover encloses the motor and impeller. The housing is designed to form a skirt which extends beyond the housing cover so that three chambers are formed which are in fluid communication. A first chamber houses the motor. A second chamber houses the impeller. A third chamber is created by the junction of the housing extension and the top of a water heater to which the blower is directly attached. The third chamber houses the water heater flue.

Referring to FIGS. 1, 2, 4 and 6, a dilution air blower 1 is shown which provides a combined blower motor housing and impeller housing that attaches directly to a hot water heater (shown in FIGS. 17–20).

Dilution air blower 1 comprises a blower housing 2 which has a blower motor side wall 5. Dilution air slots 7 are provided in motor side wall 5 to allow for the introduction of cooling air into motor side wall 5 when dilution air blower 1 is being operated. Motor housing 5 is adapted to receive a conventional motor blower. Motor bracket 6 is provided to receive a blower motor 10. Mechanical fasteners (not shown) are used to secure blower motor 10 to motor bracket 6.

Motor blower 10 has a motor shaft 12 for receiving an impeller. Attached to motor shaft 12 is an impeller 15 which can be freely rotated within dilution air blower 1. Motor housing 5 is preferably cylindrical in shape to receive a standard blower motor as is well known in the art.

Blower housing 2 has a blower housing side wall 20 within which impeller 15 is situated. Side wall 20 preferably has an inner surface 21 that is scroll shaped as shown in FIG. 3) to maximize the efficient flow of exhaust gases into an outlet 25 formed in blower housing 2.

As shown in FIG. 1, in one embodiment, blower housing 2 has portions which defined pipe apertures 23 which are sized and shaped to receive infeed and outfeed water lines (not shown) which extend above a top of a hot water heater (not shown). Bottom portions of pipe apertures 23 preferably seal against the top of the water heater to which blower housing 2 is attached so that an airtight seal is created.

Figure 2:
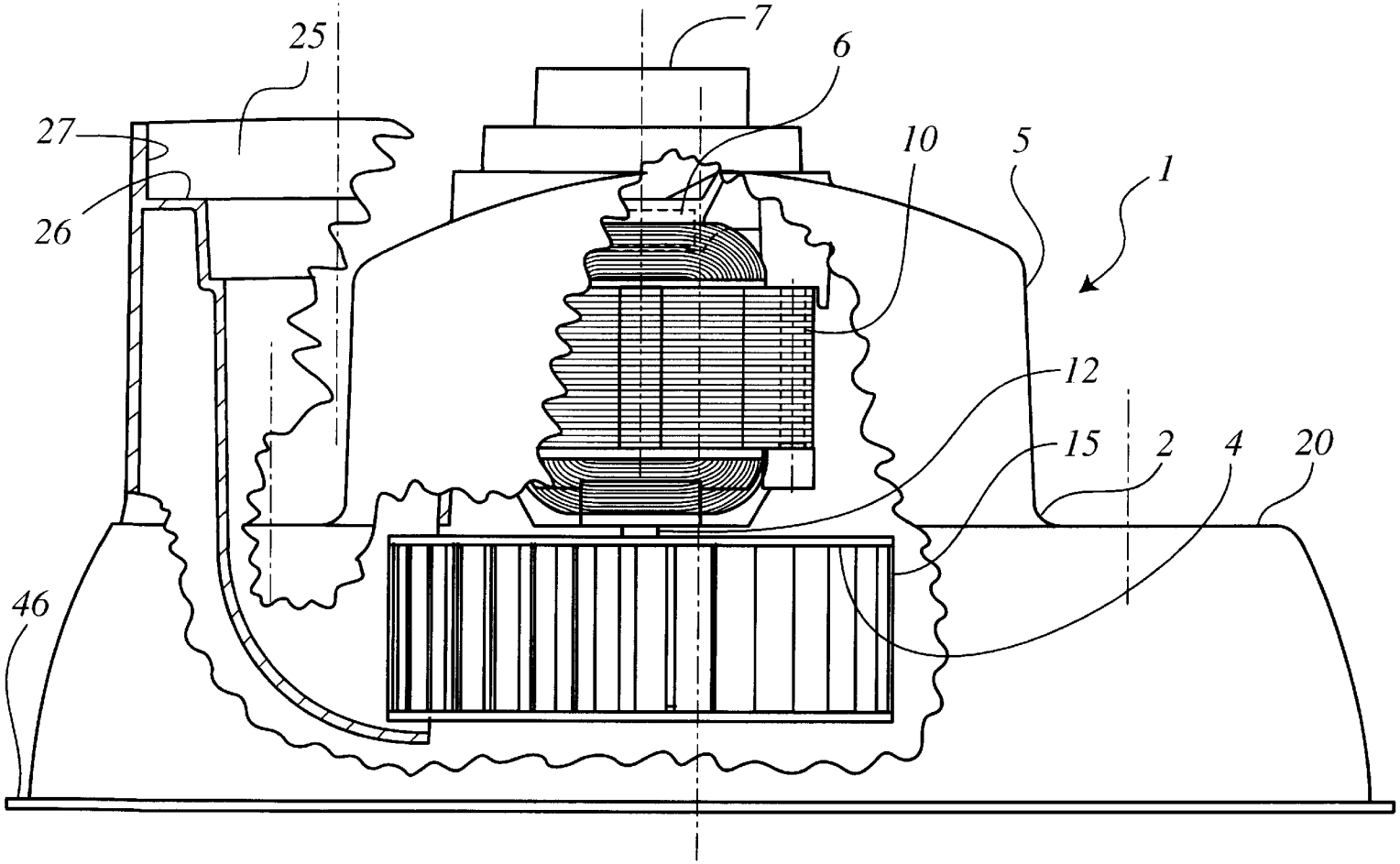
FIG. 2 is a side partial cutaway view of a dilution air blower in accordance with one embodiment of the invention.

Referring to FIG. 2, outlet 25 preferably has a should 26 which is provided as a seat to an exhaust pipe (not shown) which is used to channel the exhaust gases out of an enclosed structure such as a house basement. A top portion 27 of outlet 25 is preferably tapered with the largest end of the taper being the top most point of top portion 27. The downwardly reducing taper provides an airtight fit with an exhaust pipe that is secured into the top portion 27.

Figure 3:
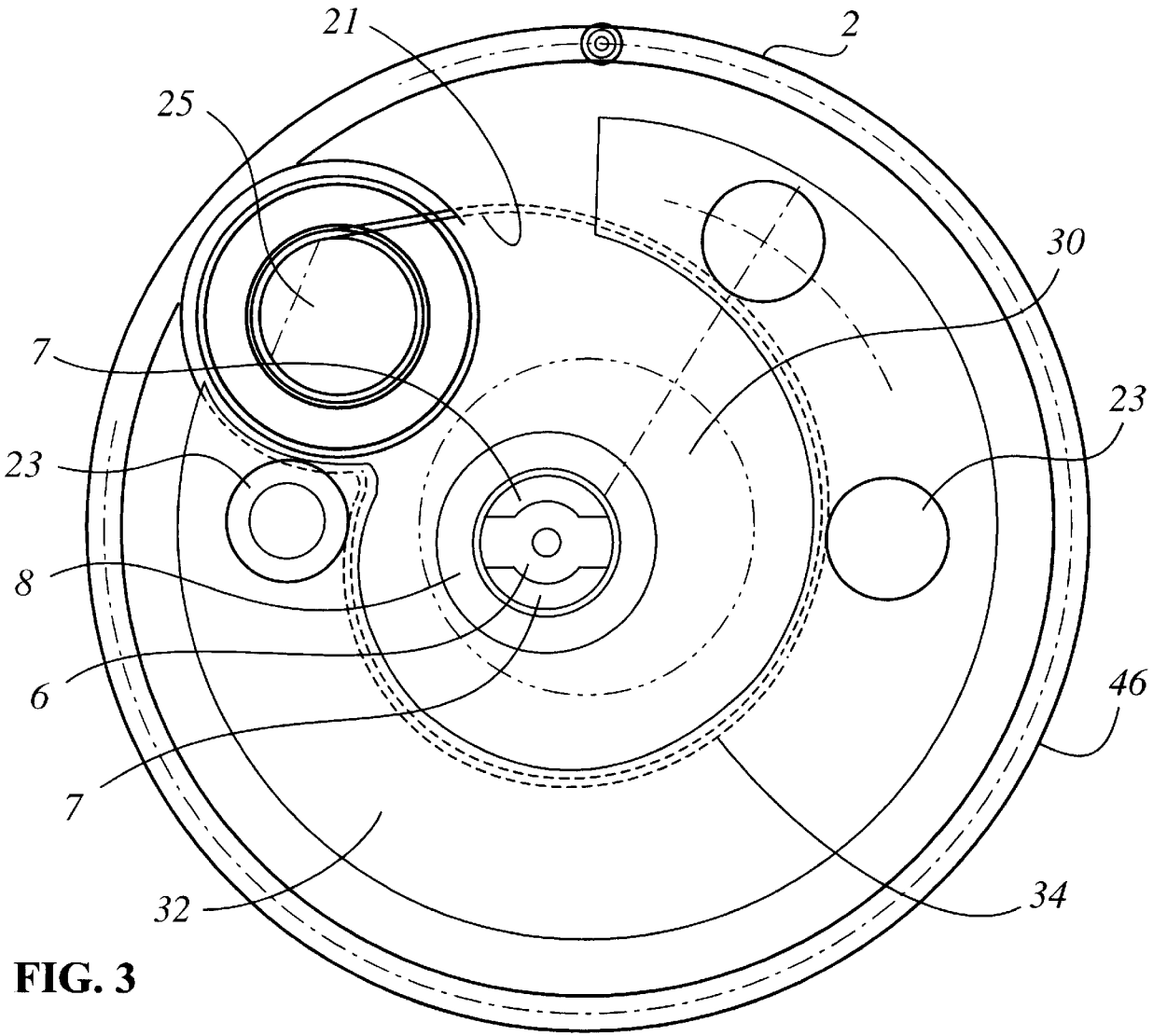
FIG. 3 is a bottom view of a dilution air blower housing in accordance with one embodiment of the invention.

Referring now to FIG. 3, a blower housing 2 having a substantially circular-shaped circumference is shown, A first chamber 30 is shown formed in blower housing 2 to receive blower motor 10. Motor bracket 6 is shown which has portions defining a shaft aperture 8 which is adapted to receive motor shaft 12. Motor shaft 12 rotates freely within shaft aperture 8.

Blower housing 2 has further portions defining a second chamber 32 which receives impeller 15. Impeller 15 rotates freely within second chamber 32. The juncture of first chamber 30 and second chamber 32 forms a cover should 34 which is adapted to receive a housing cover (not shown).

Figure 3A:
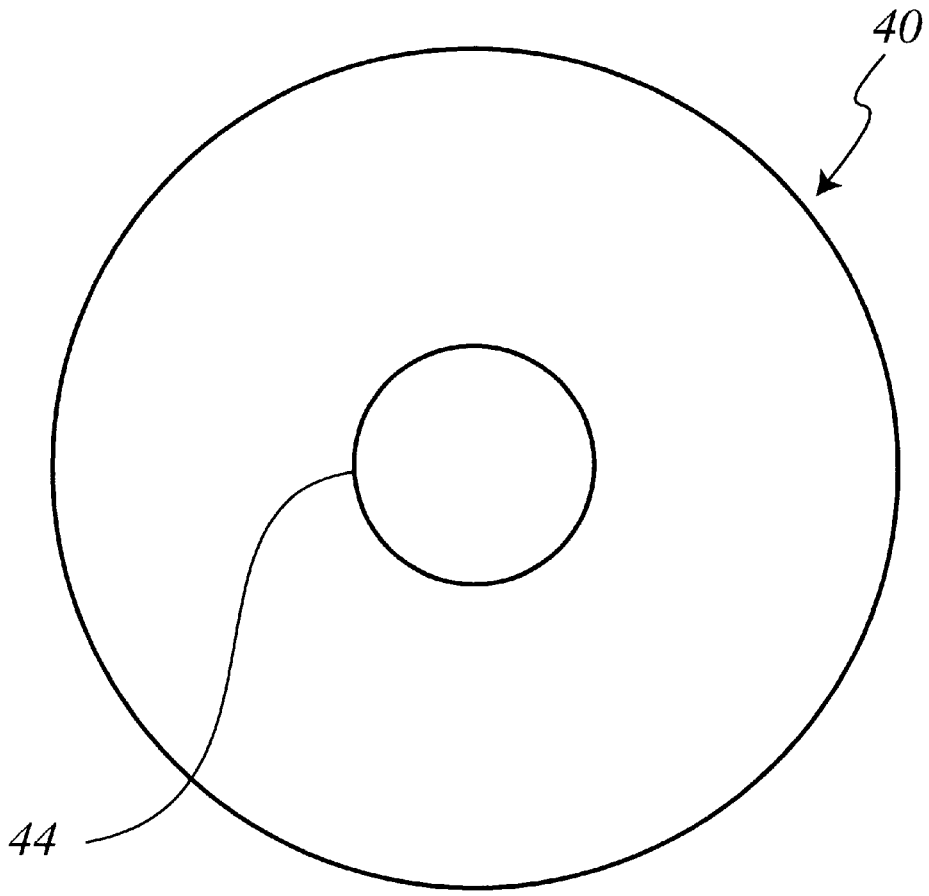
FIG. 3*a* is a bottom view of a housing cover in accordance with one embodiment of the invention.
Figure 4:
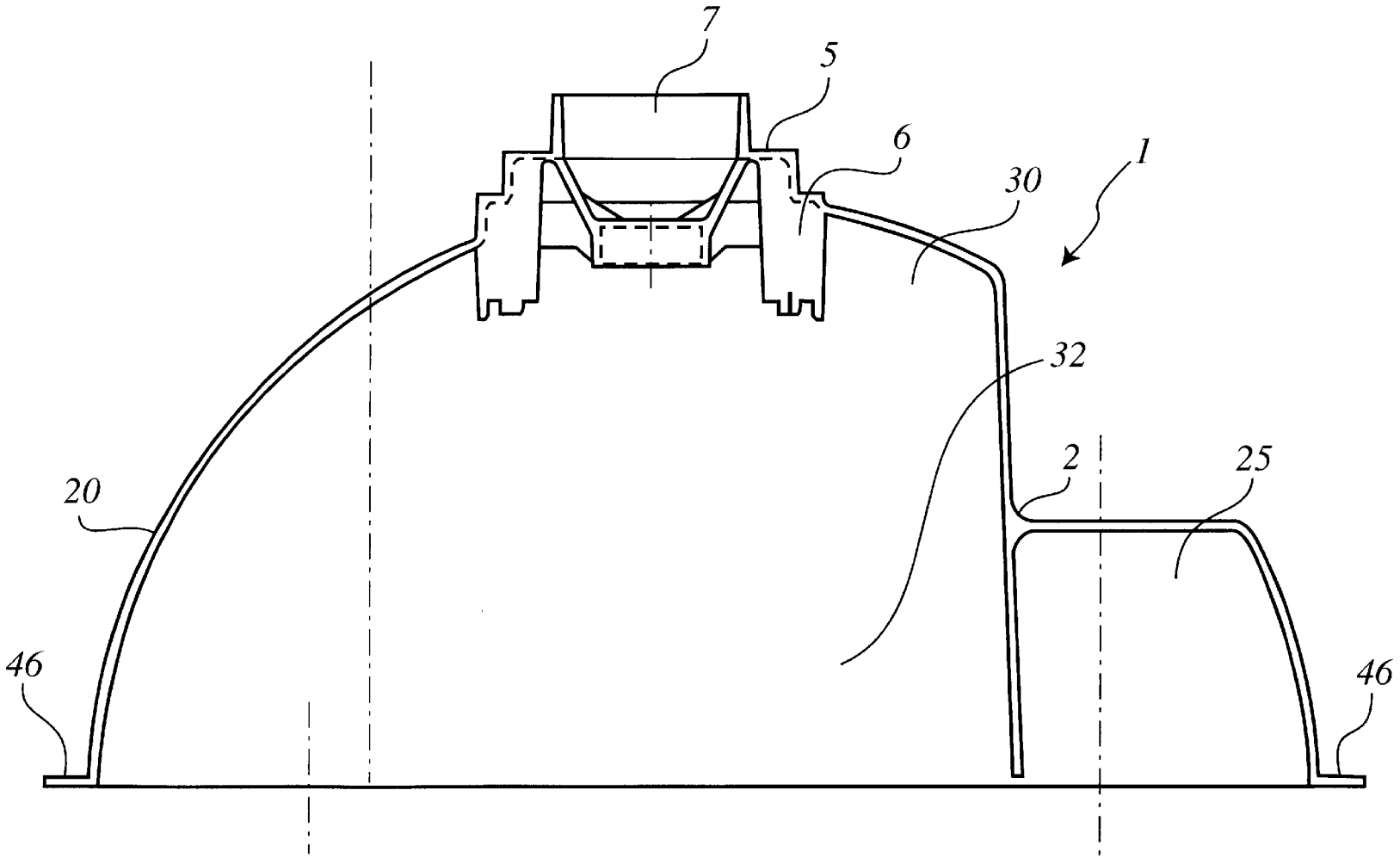
FIG. 4 is a side sectional view of a dilution air blower housing in accordance with one embodiment of the invention.

Referring now to FIG. 3*a,* a cover 40 is shown which is sized and shaped to fit within blower housing 2. Cover 40 is secured to cover shoulder 34 with any of a variety of attachment methods such as clips, mechanical fasteners, adhesives, mating locking surfaces, etc. The method used to secure cover 40 to blower housing 2 is not particularly important so long as the seal between blower housing 2 and cover 40 is tight.

Cover 40 has portions which define an inlet 44 which allows exhaust gases emanating from a hot water heater to enter second chamber 32. Inlet 44 is sized to ensure that the rotation of impeller 15 will generate the desired negative pressure.

Figure 17:
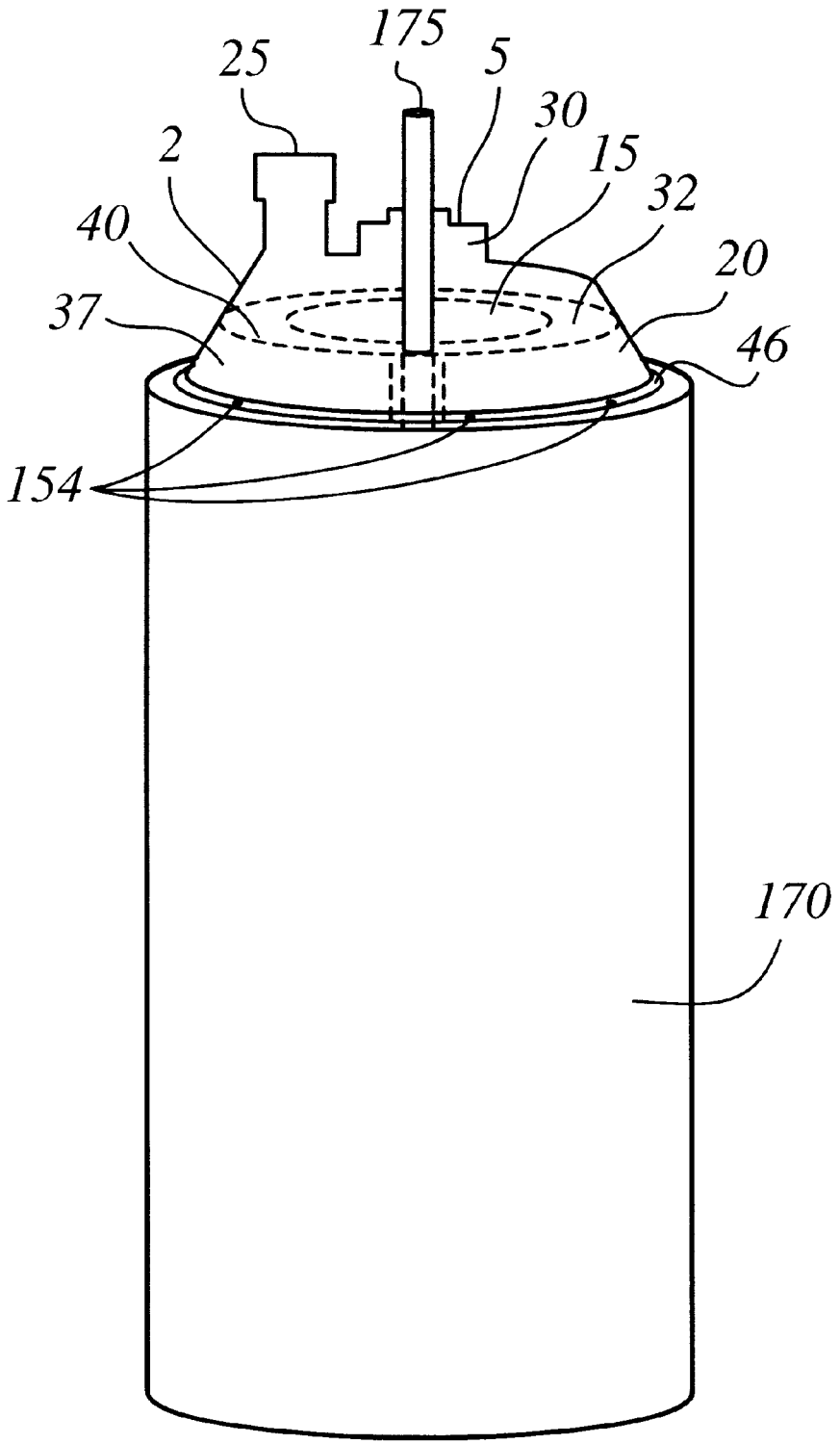
FIG. 17 is a side elevational view of a hot water heater/dilution air blower assembly in accordance with one embodiment of the invention.
Figure 19:
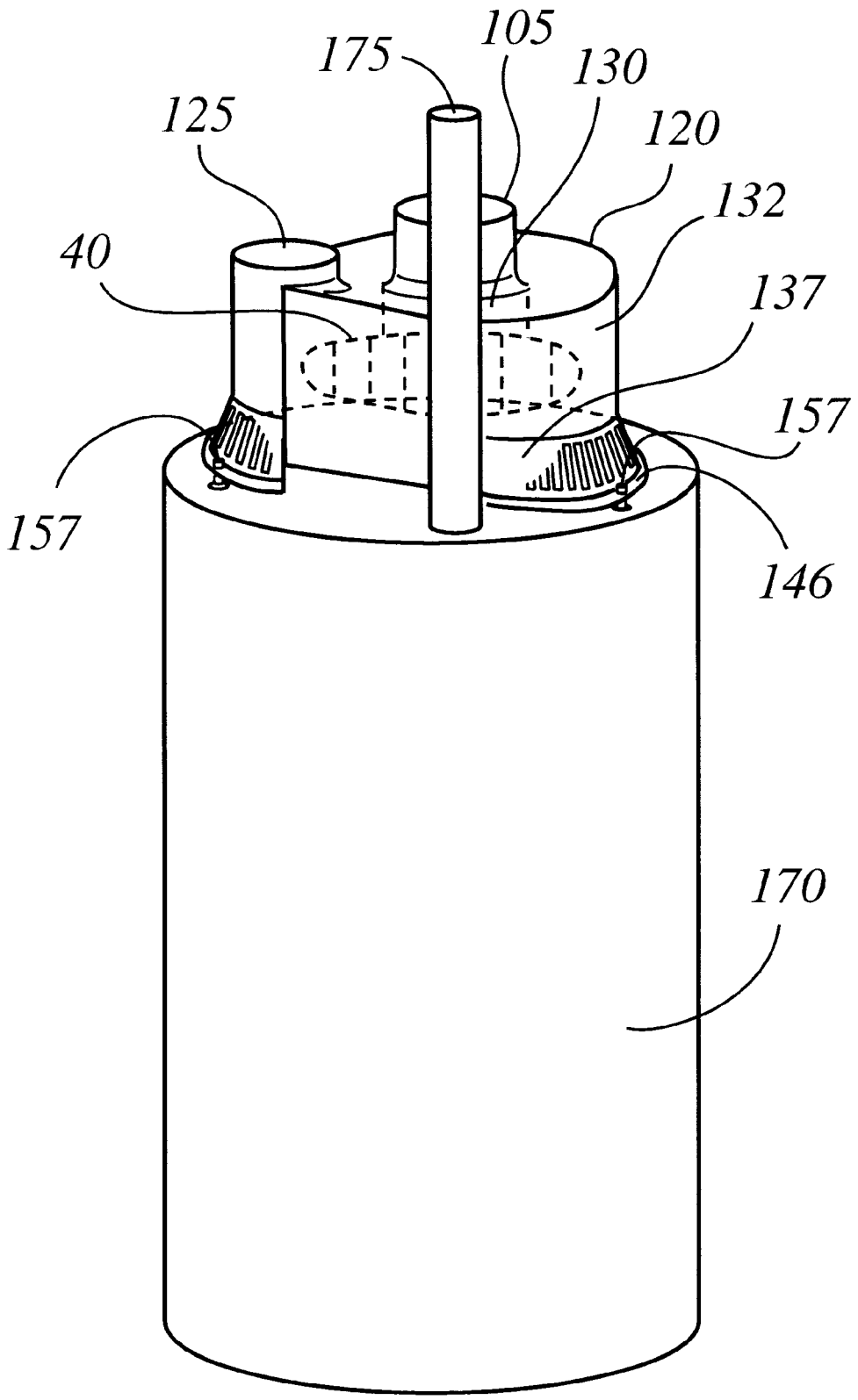
FIG. 19 is a side elevational view of a hot water heater/dilution air blower assembly in accordance with another embodiment of the invention.
Figure 20:
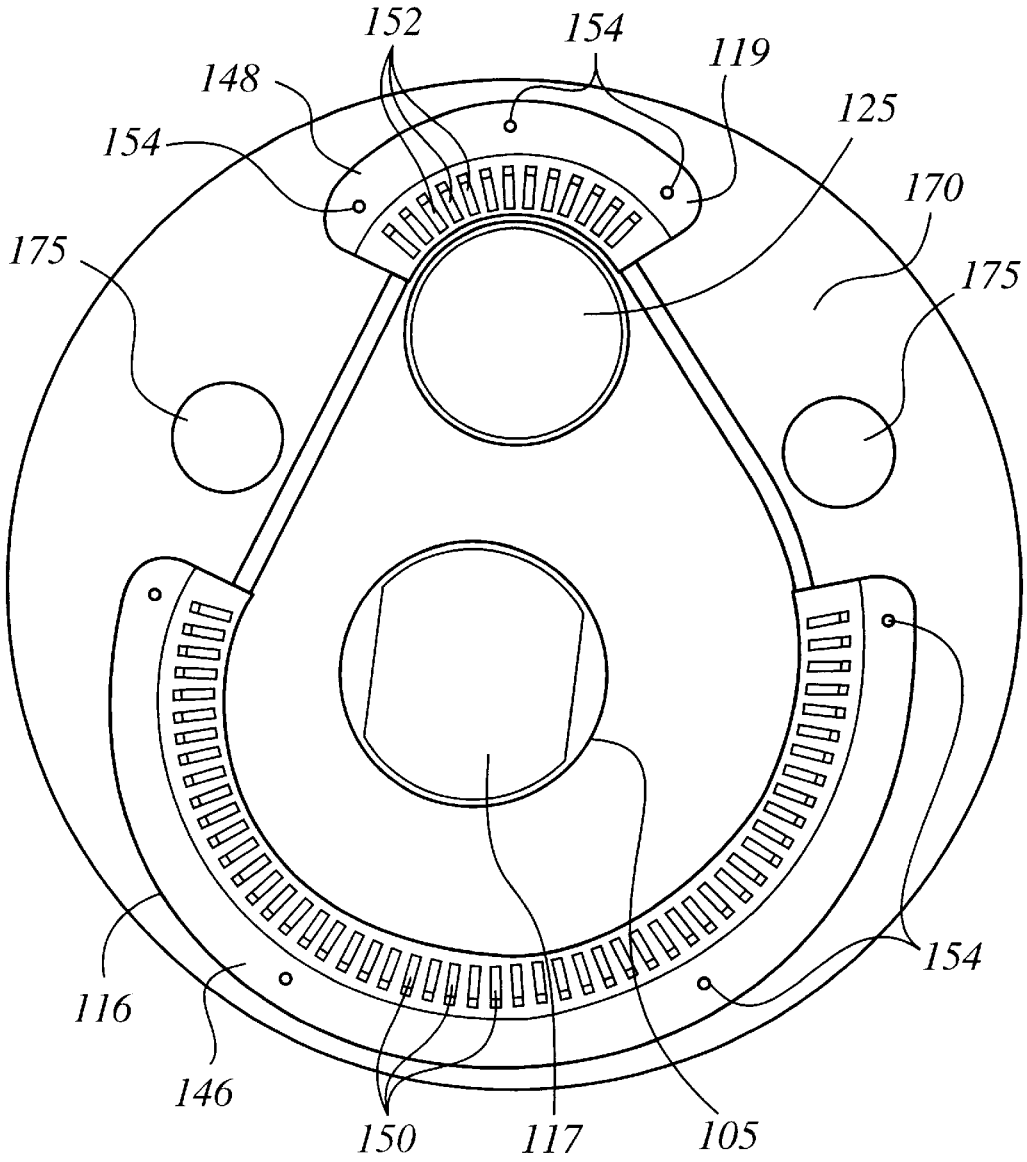
FIG. 20 is a top view of a hot water heater/dilution air blower assembly in accordance with another embodiment of the invention.

Referring again to FIGS. 1, 2 4 and 6, blower housing 2 has a flange 46 which extends radially outwardly from a bottom edge of blower housing 2. Flange 46 provides a surface for mounting blower housing 2 to a hot water heater as shown in FIGS. 17 and 19. Bores drilled into flange 46 can be provided to receive mounting bolts or screws 47 as shown in FIGS. 17 and 19.

Figure 5:
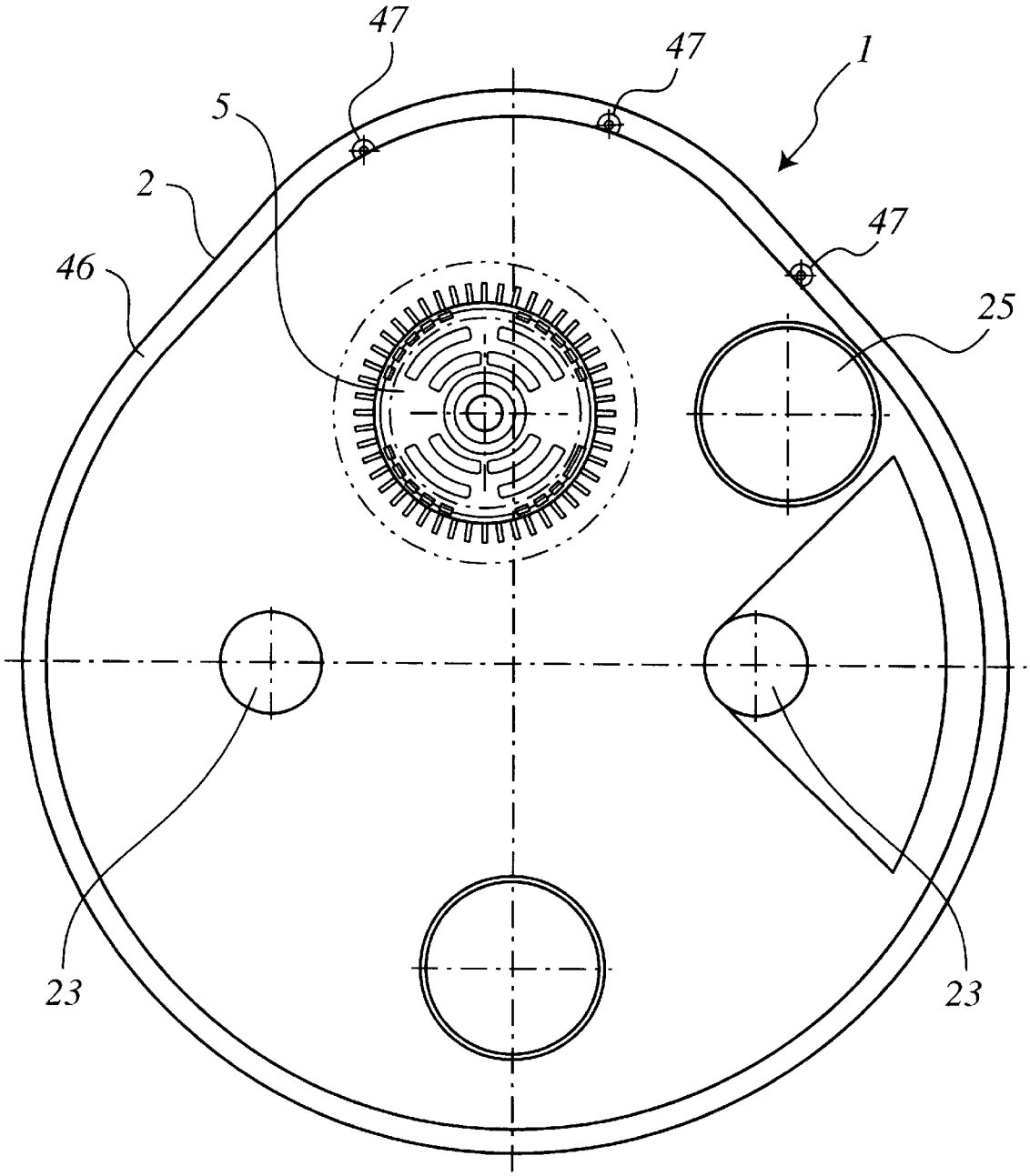
FIG. 5 is a top view of a dilution air blower housing in accordance with one embodiment of the invention.
Figure 6:
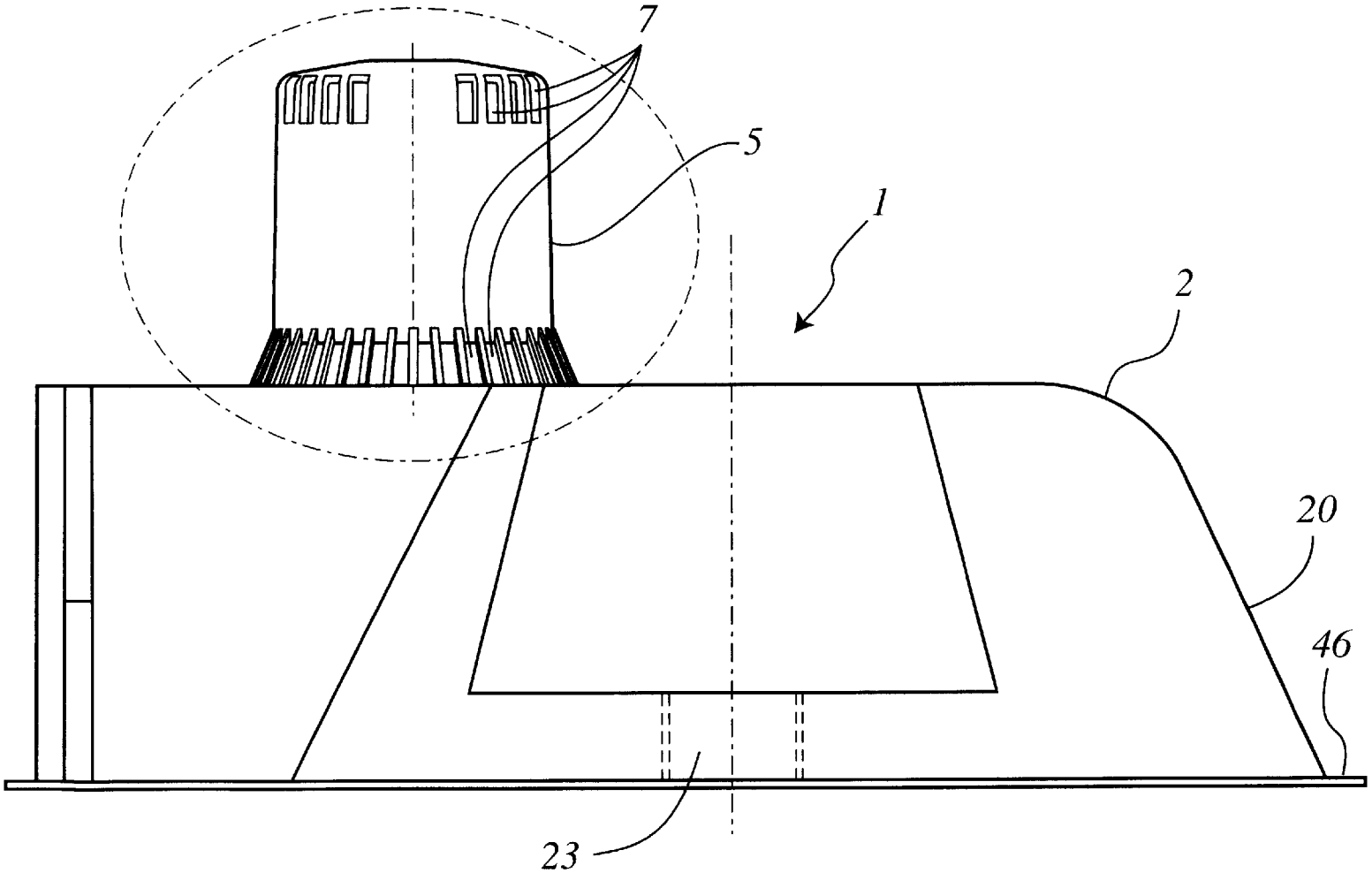
FIG. 6 is a side elevational view of a dilution air blower housing in accordance with one embodiment of the invention.
Figure 7:
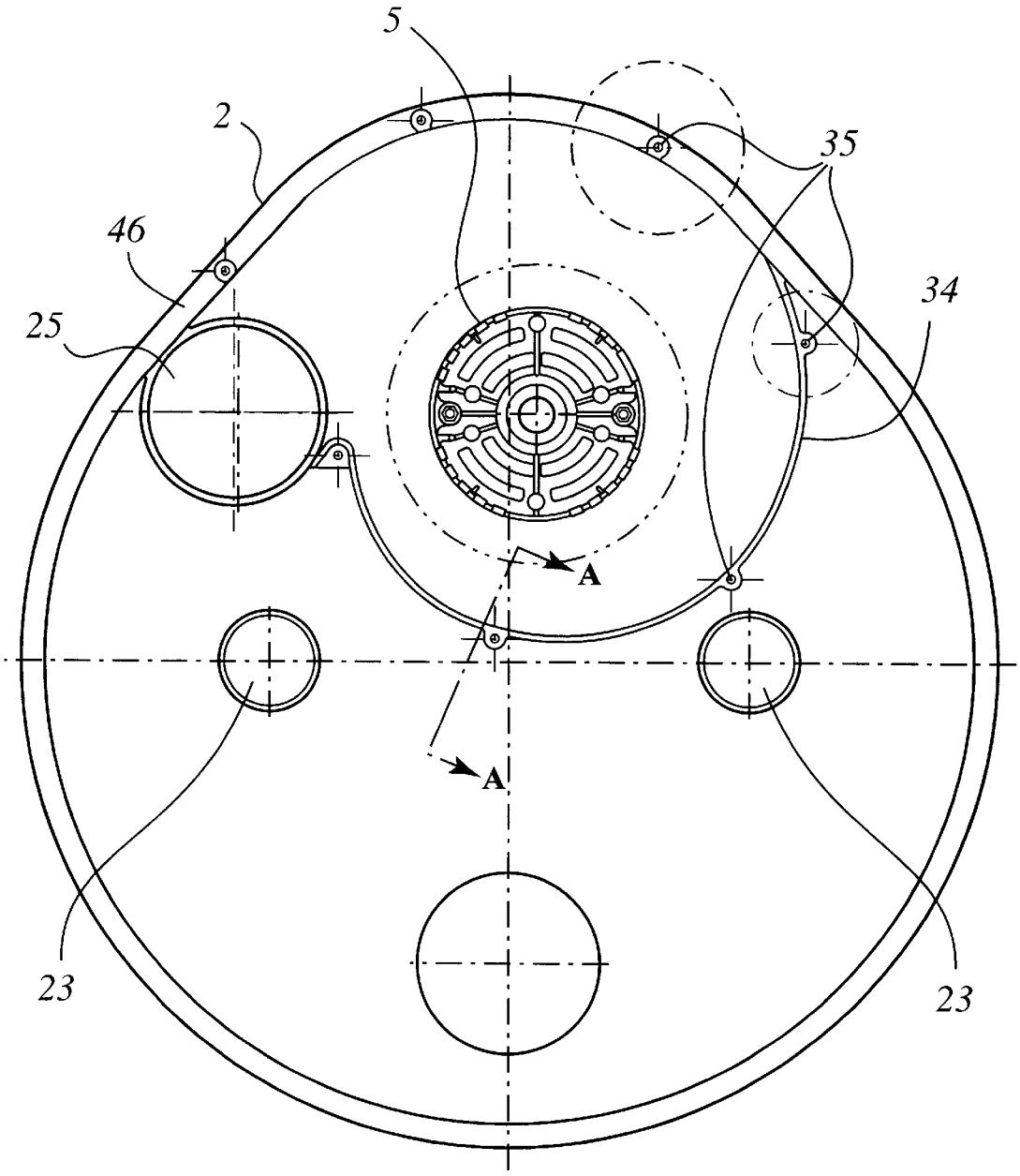
FIG. 7 is a bottom view of a dilution air blower in accordance with one embodiment of the invention.
Figure 8:
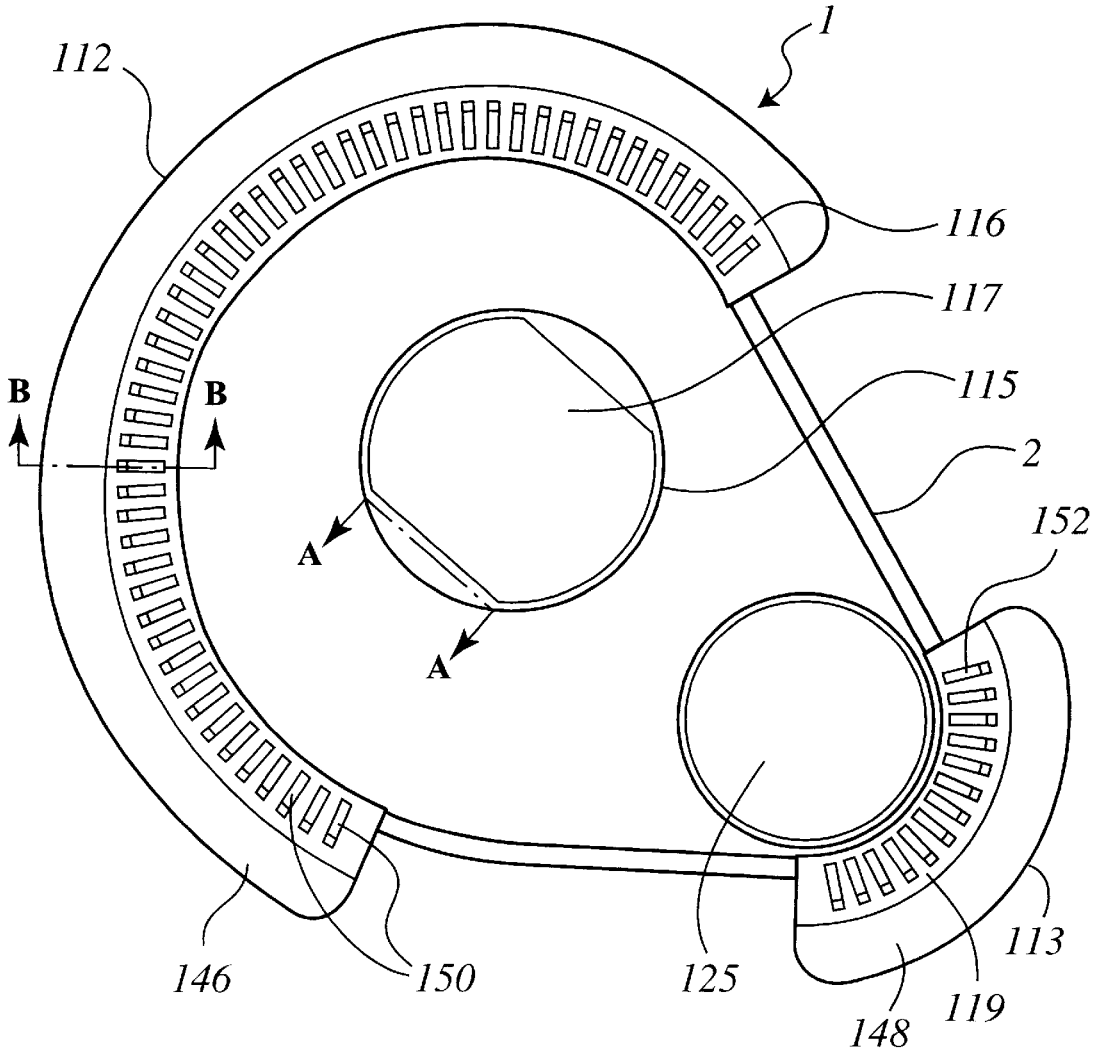
FIG. 8 is a top view of a dilution air blower housing in accordance with another embodiment of the invention.

Turning to FIG. 5, another embodiment for blower housing 2 is shown wherein the blower housing 2 has a partial elliptical shape. Motor housing 5 and outlet 25 are positioned proximal to the elliptical portion of blower housing 2. FIG. 7 shows a bottom view of the embodiment shown in FIG. 5. As shown, cover shoulder 34 has portions which define mounting bores 35 which are adapted to receive mechanical fasteners to secure cover 40 to blower housing 2.

Referring now to FIGS. 8 and 10–16, another embodiment of blower housing 2 is shown which is adapted to fit about the infeed and outfeed water lines of a hot water heater (as shown in FIG. 19). In this embodiment, blower housing 2 is substantially elliptical-shaped such that a larger elliptical end 112 and a smaller elliptical end 113 are formed. An outlet 125 is situated in smaller end 113 and motor housing 115 is situated toward the larger end 112. Larger end 112 has portions which define a first skirt 116. Smaller end 113 has portions which define a second skirt 119.

Provided in first skirt 116 are first skirt vent slots 150. Provided in second skirt 119 are second skirt vents slots 152. Vent slots 150 and 152 provide dilution air to a third chamber 37 in one embodiment as shown in FIG. 17 and a third chamber 137 in another embodiment as shown in FIG. 19.

A first flange 146 extends radially from first skirt 116 and a second flange 148 extends radially from second skirt 119. Flange bores 154 are provided in first flange 146 and second flange 148 for securing blower housing 2 to top of a hot water heater with mechanical fasteners 157 as shown in FIG. 19. By design, the blower housing of the present invention is secured directly to the top of a hot water heater so that an exhaust flue that extends above the top surface of the hot water heater will be above the lowest portion of the first and second skirt. This enables the formation of the third chamber 37 and 137 which is critical to the functioning of the invention.

Figure 2B:
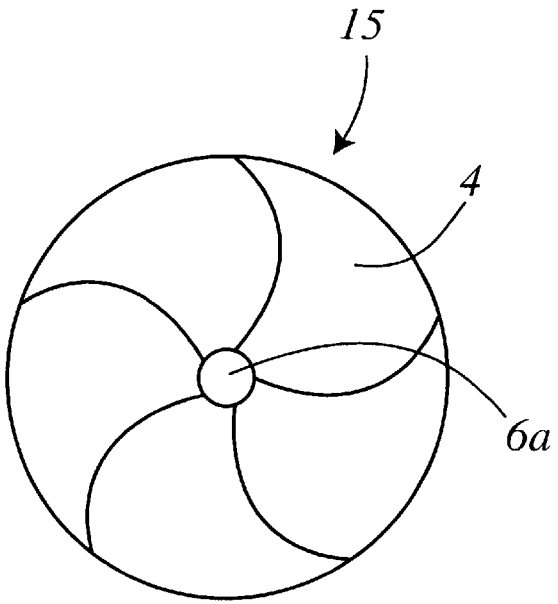
FIG. 2*b* is a plan view of an impeller in accordance with another embodiment of the invention.
Figure 2A:
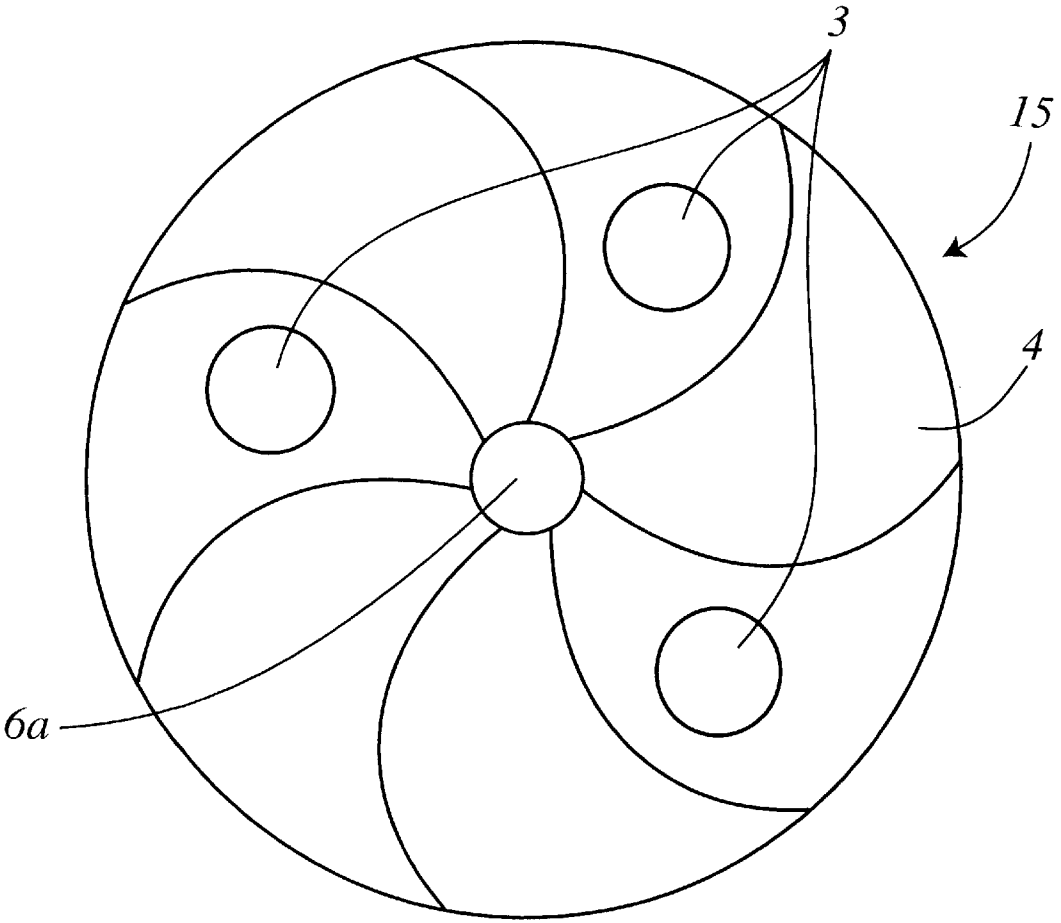
FIG. 2*a* is a plan view of an impeller in accordance with one embodiment of the invention.

Housing 2 has portions which define a motor housing side wall 105 and portions which define an impeller housing side wall 120. A first chamber 130 for housing a blower motor (not shown) is formed by motor housing side wall 105. And, a second chamber 132 for housing an impeller (not shown) is formed by impeller housing side wall 120. First chamber 130 and second chamber 132 are in fluid communication by virtue of apertures 3 formed in a backplate 4 of impeller 15 as shown in FIG. 2*a.* As shown in FIG. 2*a,* a shaft aperture 6*a* is formed concentric with a center point of backplate 4 for receiving motor shaft 12. In an alternate embodiment as shown in FIG. 2*b,* impeller 15 does not have apertures 3.

Figure 2C:
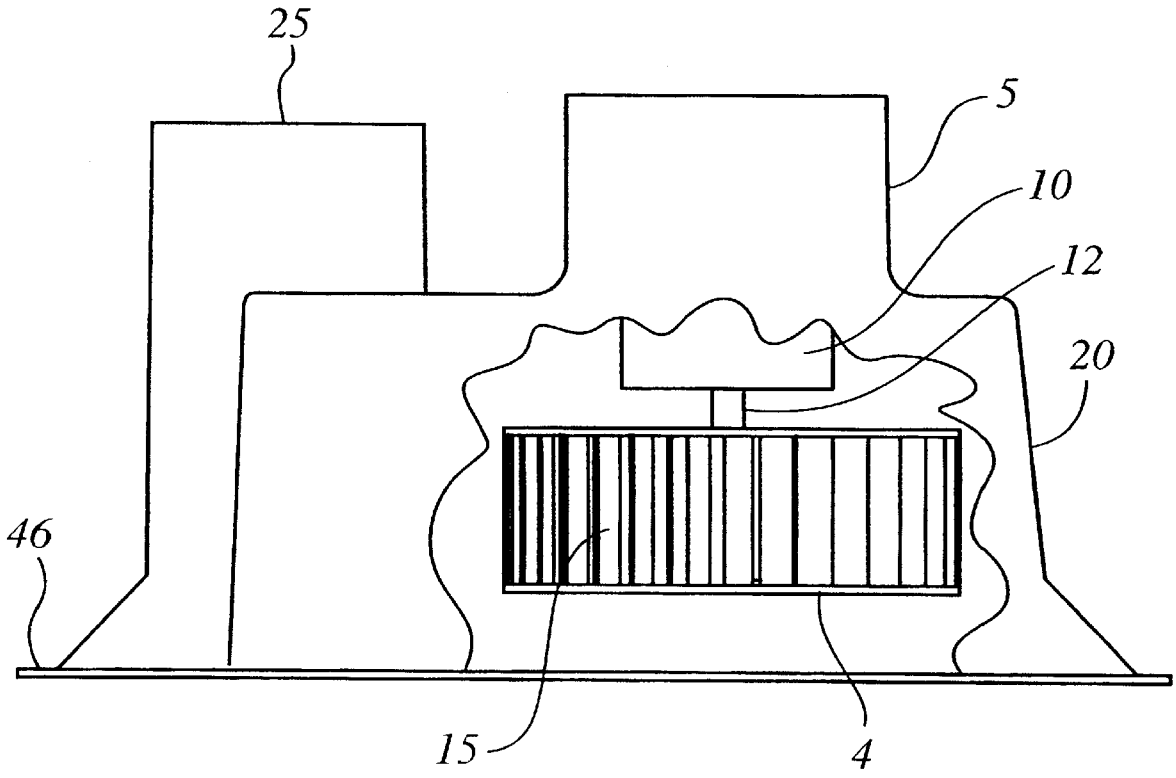
FIG. 2*c* is a side partial cutaway view of a dilution air blower in accordance with another embodiment of the invention.

Fluid communication between first chamber 130 and second chamber 132 is accomplished by setting impeller 15 on motor shaft 12 so that a gap exists between backplate 4 of impeller 15 and motor housing 105. Impeller 15 can be placed on motor shaft 12 so that backplate 4 is proximal to housing cover 40 and distal to motor housing 105 as shown in FIG. 2 or distal to housing cover 40 and proximal to motor housing 105 as shown in FIG. 2*c*.

Motor mounting bores 158 are provided on a top surface of blower housing 2 for receiving mechanical fasteners to secure a blower motor to blower housing 2. A main vent slot 117 is formed on the top surface blower housing 2.

Figure 9:
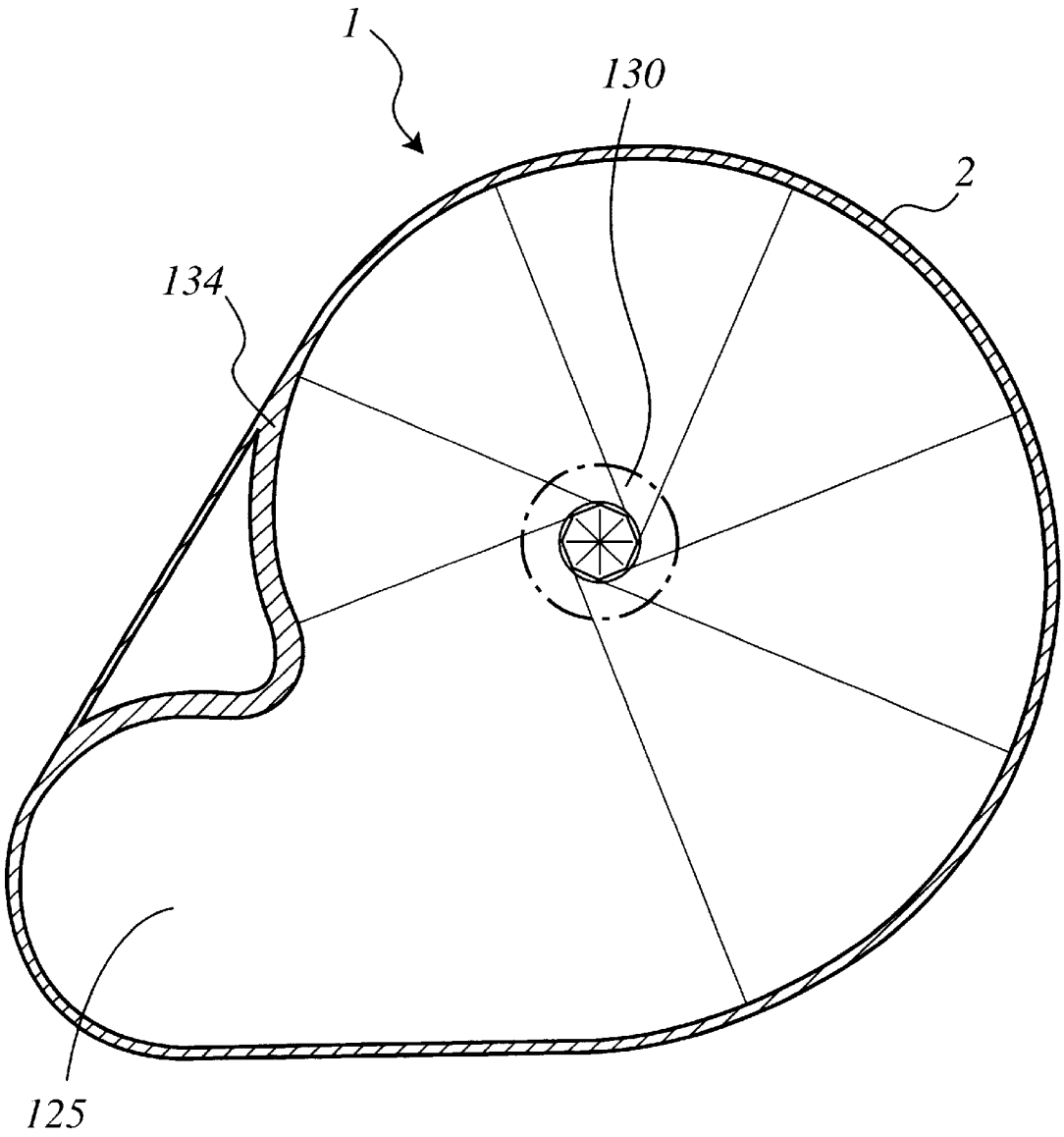
FIG. 9 is a bottom sectional view of a dilution air blower housing in accordance with another embodiment of the invention.
Figure 10:
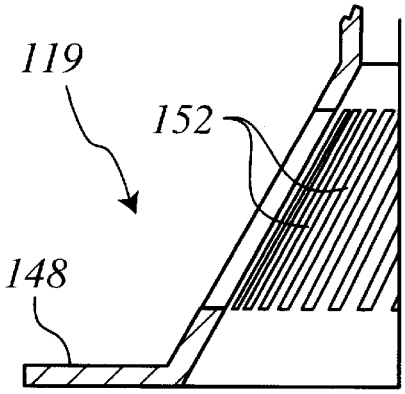
FIG. 10 is a side elevational view of a vent skirt in accordance with another embodiment of the invention.
Figure 11:
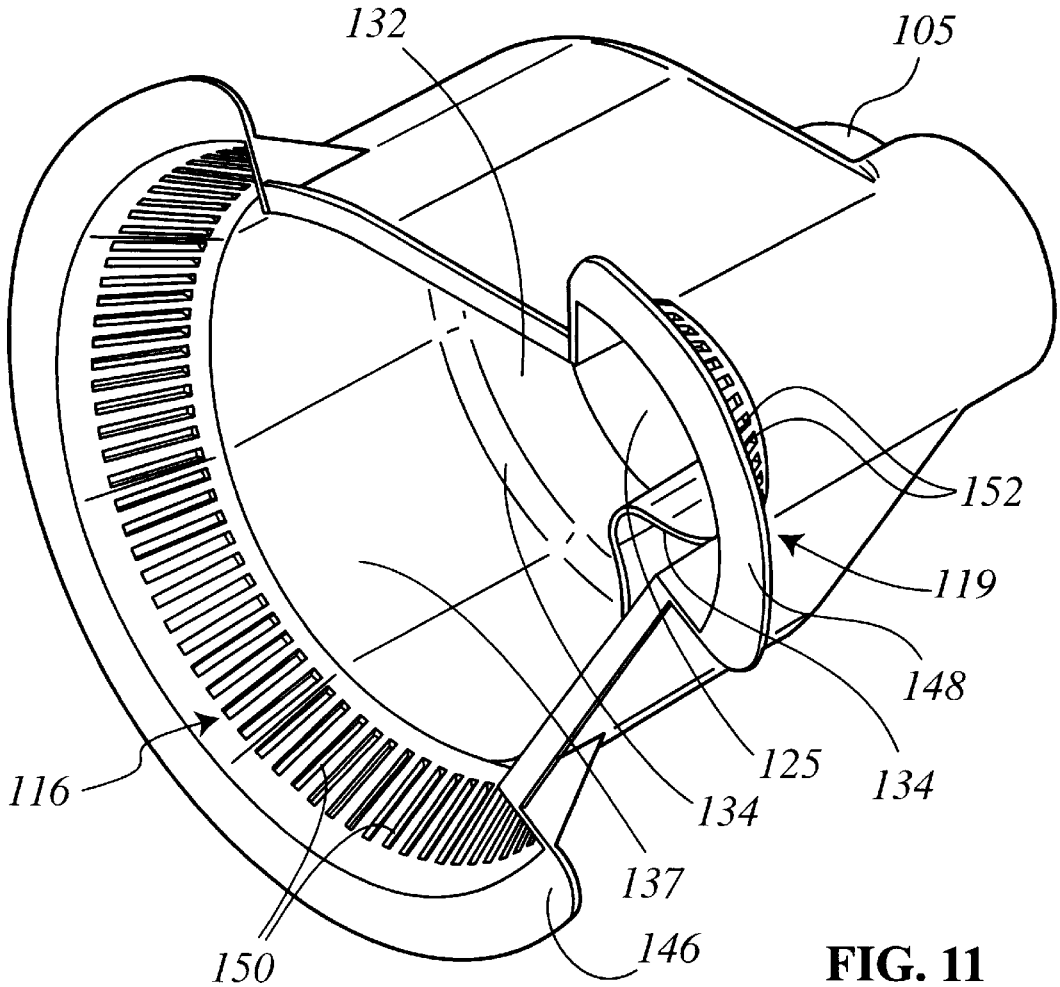
FIG. 11 is a front bottom perspective view of a dilution air blower housing in accordance with another embodiment of the invention.
Figure 12:
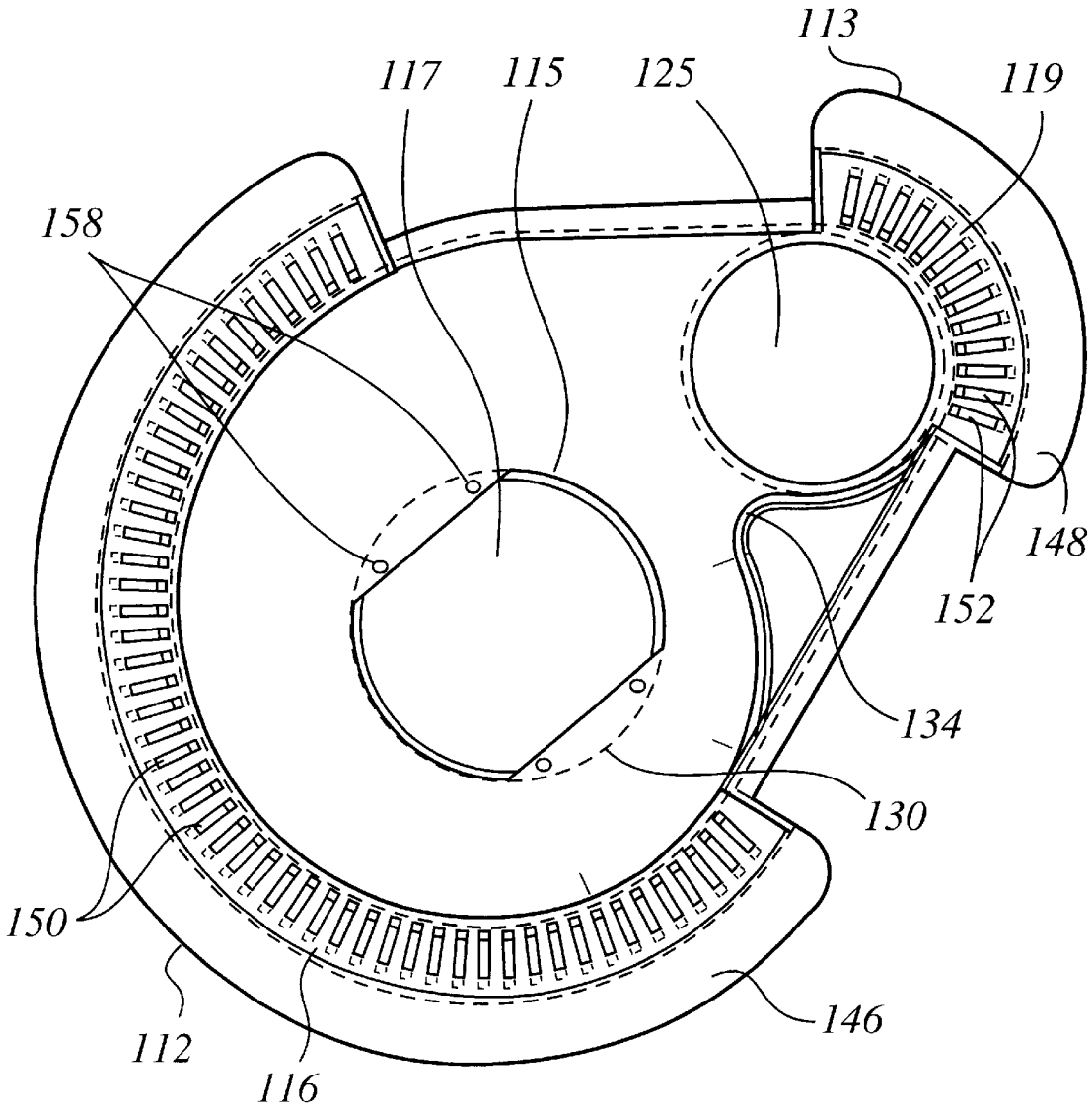
FIG. 12 is a bottom view of a dilution air blower housing in accordance with another embodiment of the invention.
Figure 13:
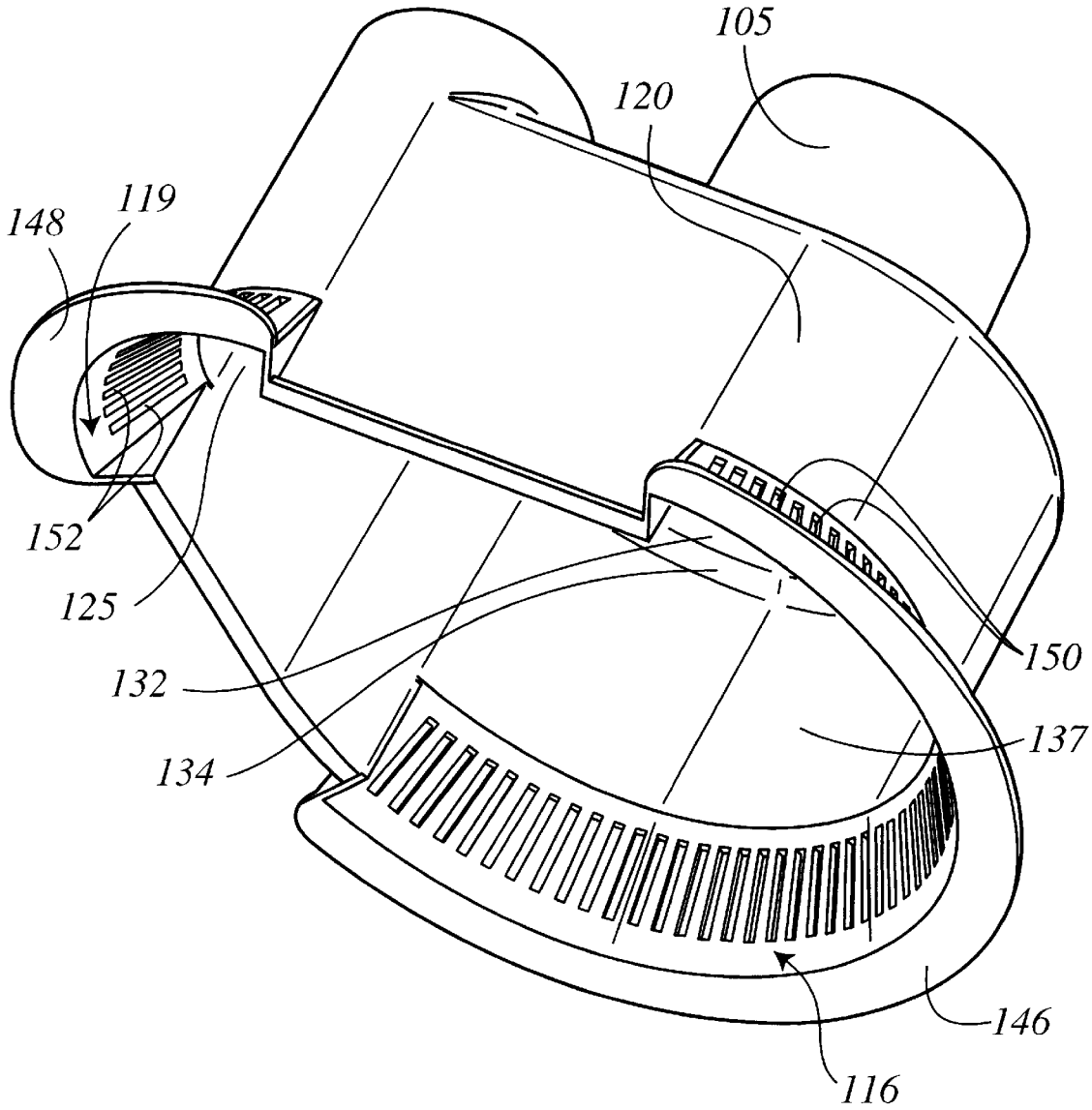
FIG. 13 is a side perspective view of a dilution air blower housing in accordance with another embodiment of the invention.
Figure 14:
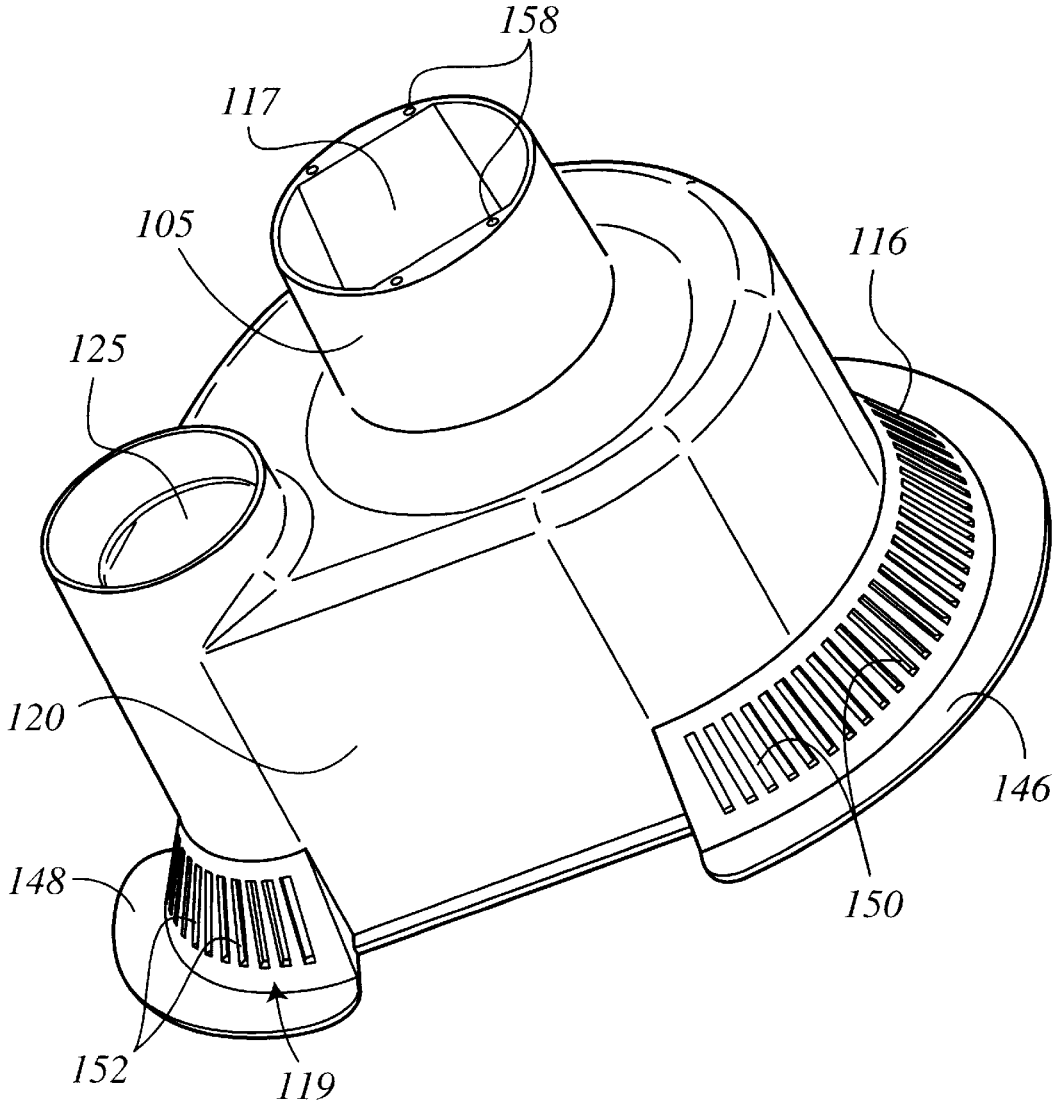
FIG. 14 is a top perspective view of a dilution air blower housing in accordance with another embodiment of the invention.
Figure 15:
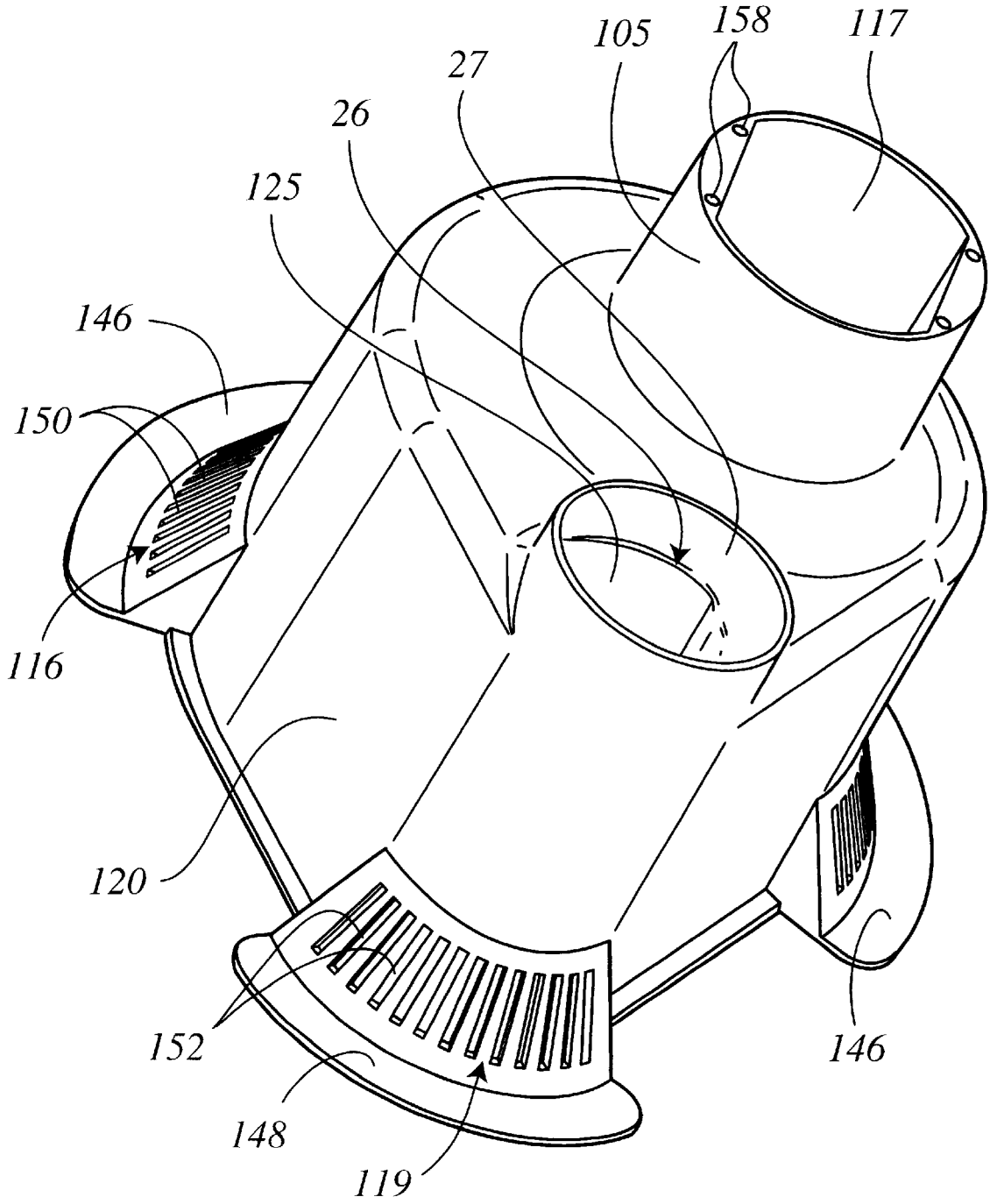
FIG. 15 is a front top perspective view of a dilution air blower housing in accordance with another embodiment of the invention.
Figure 16:
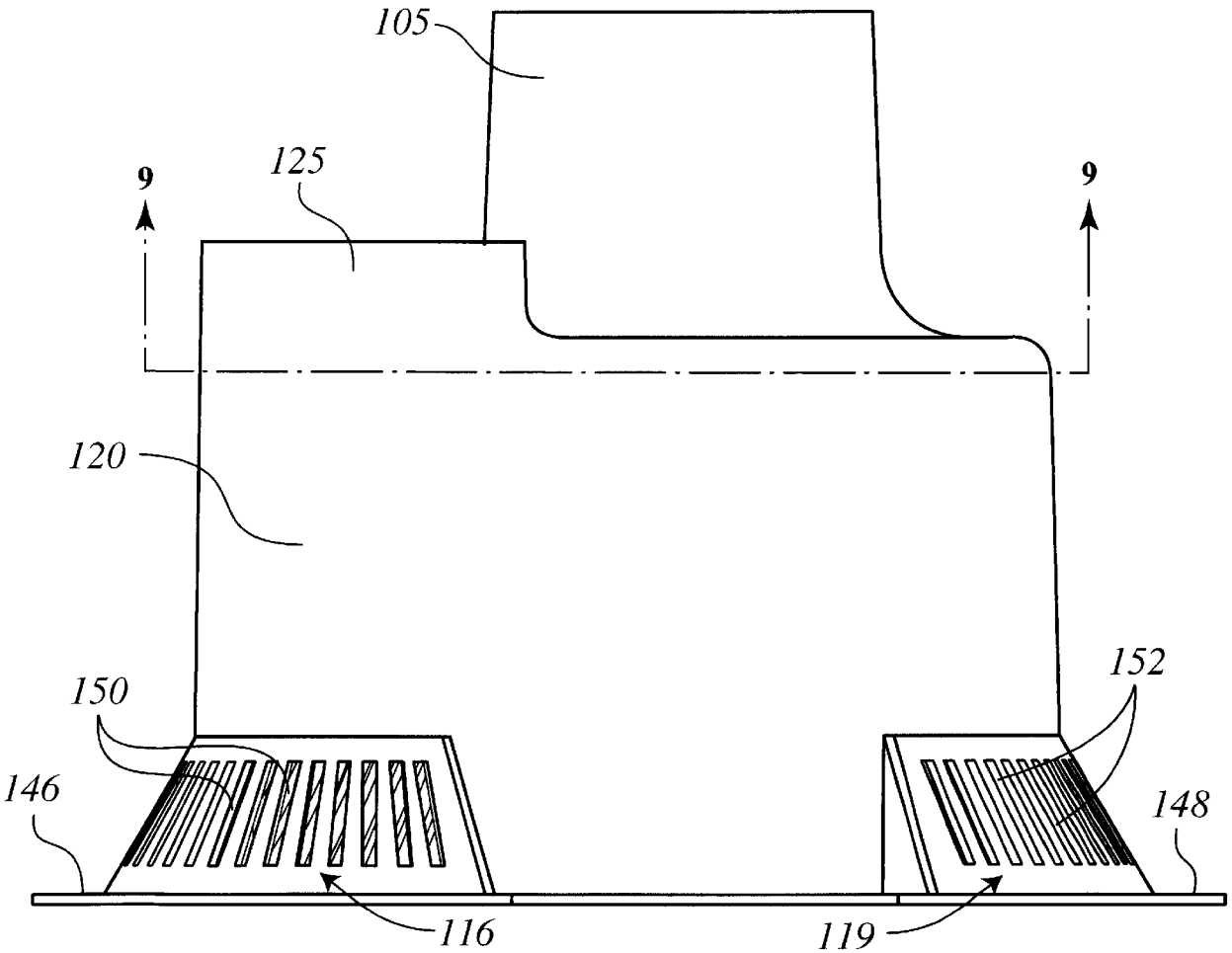
FIG. 16 is a side view of a dilution air blower housing in accordance with another embodiment of the invention.

Turning to FIG. 9, a sectional bottom view of blower housing 2 is shown in a plane where a cover shoulder 134 is formed. Cover shoulder 134 is preferably scroll-shaped to allow for the efficient flow of exhaust gases toward outlet 125.

Figure 18:
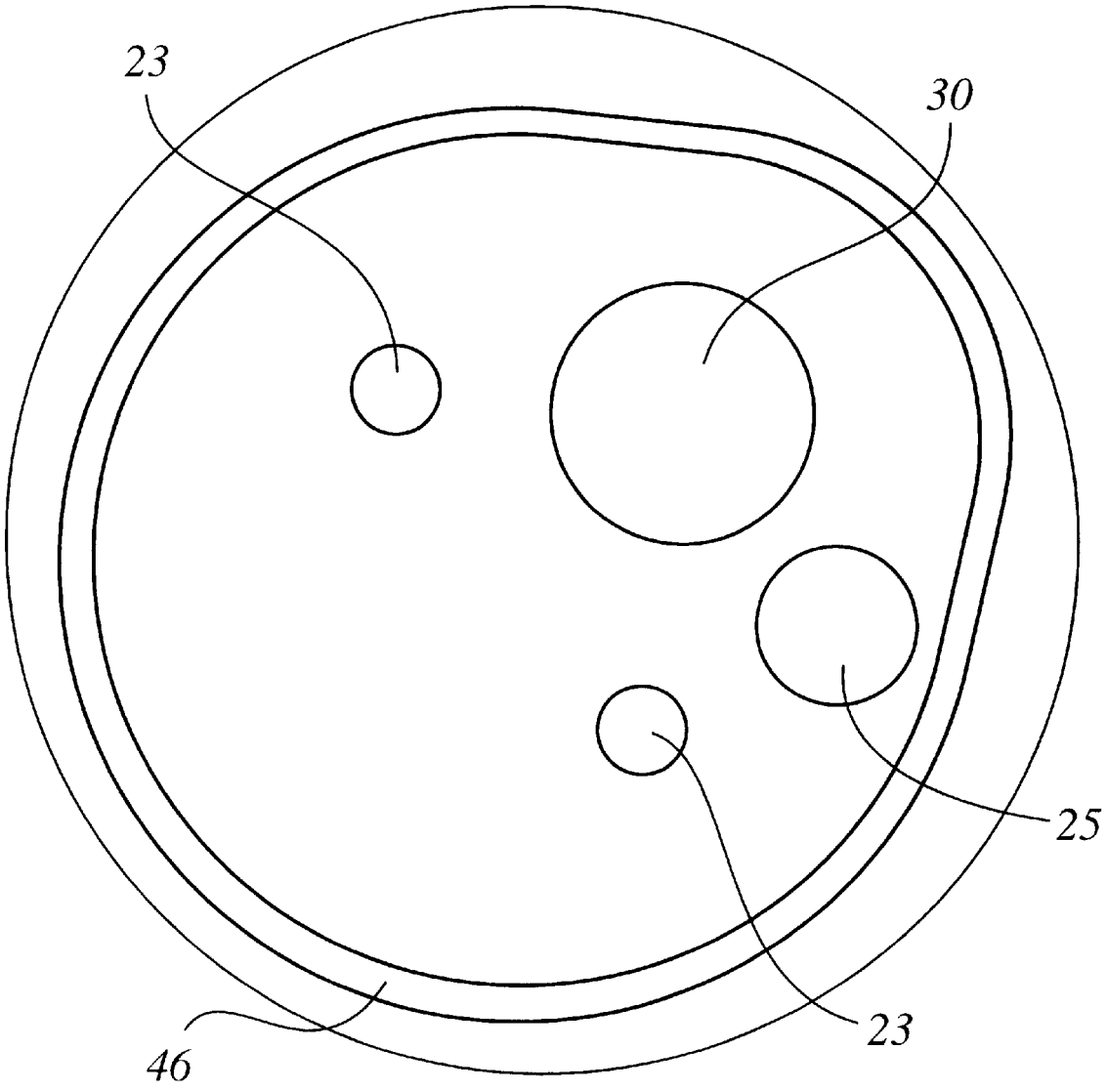
FIG. 18 is a top view of a hot water heater/dilution air blower assembly in accordance with one embodiment of the invention.

Referring now to FIGS. 17–20, side and top views of two embodiments of blowers/hot water heater assemblies are shown. In one embodiment as shown in FIGS. 17 and 18, a third chamber 37 is formed by the combination of housing cover 40, a portion of side wall 20 and a top surface of hot water heater 170. Infeed and outfeed water pipes 175 are channeled through apertures 23. An exhaust flue 172 shown in FIGS. 21 and 22 and is confined in third chamber 37. Preferably, exhaust flue 172 does not contact housing cover 40.

In a second embodiment, blower housing 2 fits between infeed and outfeed water pipes 175. In this embodiment, exhaust flue 172 is confined in a third chamber 137 formed by the combination of housing cover 40, a portion of side wall 120 and the top of hot water heater 170.

Having described the components of dilution air blower 1, attention will not be drawn to the operation of dilution air blower 1. Operation of motor 10 causes the rotation of impeller 20. Rotation of impeller 20 creates negative air pressure in second chamber 32 or 132 depending on the embodiment, which causes air to be drawn into second chamber 32 or 132 from adjacent first chamber 30 or 132 depending on the embodiment, which causes air to be drawn into second chamber 32 or 132 from adjacent chamber 37 or 137 via inlet 44. The drawing of air from the first and third chambers causes the development of negative air pressure in the first and third chambers.

Vent slots 17 or 117, depending on the particular embodiment, allow for the passage of dilution air into first chamber 30 or 130 which is drawn in due to the negative air pressure. First and second skirt vent slots 150 and 152 allow for the passage of dilution air into third chamber 37 or 137 again, due to the negative air pressure created in the third chamber.

The dilution air passing into first chamber 30 or 130 is drawn past blower motor 10 which cools motor 10. The dilution air is then drawn into second chamber 32 or 132 where it mixes with any gases contained in the second chamber.

The dilution air passing into third chamber 37 or 137 is drawn mixes with exhaust gases flowing out of exhaust flue 172. This results in a desirable reduction in temperature of the exhaust gases. The mixed dilution air and exhaust gases are then drawn into the second chamber 32 or 132 where they are mixed with any dilution air from the first chamber. This results in a further reduction of the exhaust gas temperature. The rotation of impeller 15 drives the mixed gases into outlet 25 or 125 for final expulsion from the hot water heater system.

To control the flow of dilution air from either the first chamber or third chamber, the number of skirt vent slots and the orientation of the dilution air blower to the hot water heater can be modified. A reduction in vent slots (motor housing vent slots or skirt vent slots) will lessen the amount of dilution air entering the blower. Conversely, an increase in vent slots will increase the amount of air entering the blower. It is to be cautioned that too many vent slots will cause an undesirable reduction in negative air pressure development which will render the system inefficient. On the other hand, even one skirt vent slot could be used to accomplish the cooling tasks. Even further, no vent slots can be used in the skirt so long as adequate vent slots are provided in the motor housing to allow for the infiltration of dilution air. Again, one slot in the motor housing may be sufficient depending on the application.

Figure 22:
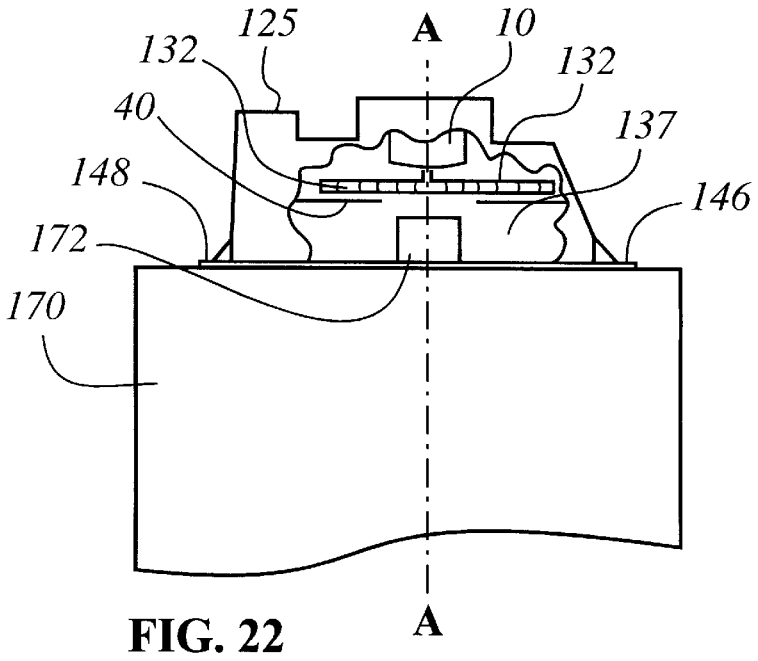
FIG. 22 is a partial-side view, partially cut away view of another exemplary embodiment of a dilution air blower in accordance with the invention.

The other variable that can be altered to effect dilution air flow is the axial orientation of motor shaft 12 to the exhaust flue 172. It is to be understood that the following explanation assumes that motor shaft 12 is in substantial axial alignment with a center point of inlet 44. In one embodiment as shown in FIG. 22, the longitudinal axes of motor shaft 12 and exhaust flue 172 are in alignment.

Figure 21:
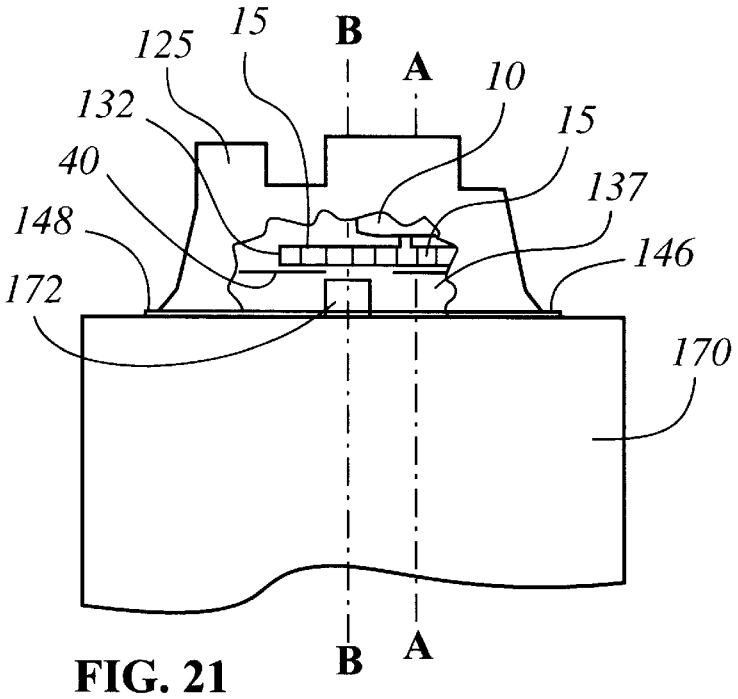
FIG. 21 is a partial-side view, partially cut away view of another exemplary embodiment of a dilution air blower in accordance with the invention.

In another embodiment as shown in FIG. 21, the longitudinal axis of motor shaft 12 is offset or biased toward first skirt 116 relative to the longitudinal axis of exhaust flue 172. This causes a stronger draw of dilution air from the first skirt vent slots 150 relative to when motor shaft 12 and exhaust flue 172 are in axial alignment.

Accordingly, the number of vent slots in the first and second skirts can be modified along with axial orientation of the blower to the water heater to obtain an optimum flow of dilution air over the motor and into the third chamber for mixing with exhaust gases drawn from and rising from exhaust flue 172. It is quite possible to obtain effective blower function by eliminating slots in either the first skirt 116 or second skirt 119 and adjusting the axial orientation of the blower 1 relative to exhaust flue 172.

By modifying the placement and number of vent slots along with the axial orientation of the blower to the water heater flue, one skilled in the art can control dilution air to maximize any function such as motor cooling or exhaust gas cooling as well as optimize the amount of dilution air drawn into the blower to accomplish the varied tasks. With the invention described herein, it is not possible to optimize 1) operating efficiency, i.e., combustion efficiency, 2) recovery efficiency, i.e., the time needed to return to a designated water temperature after use and 3) standby efficiency, i.e., minimize heat loss out of the exhaust flue while the water heater is in a standby mode.

It is to be understood that the present invention is by no means limited to the particular constructions herein disclosed and/or shown in the drawings, but also comprises any modifications or equivalents within the scope of the claims.

Having thus described out invention, what we claim as new and desire to secure by United States Letters Patent is:

1. A dilution air blower comprising:

a blower housing comprising a motor housing forming a first chamber having with at least one vent slot, an impeller housing forming a second chamber and a skirt wherein the first chamber and second chamber are in fluid communication;

a blower motor having a motor shaft and situated in the motor housing;

an impeller having a backplate wherein the impeller is secured to the motor shaft and situated in the impeller housing such that the impeller can freely rotate within the impeller housing; and, a housing cover having portions defining an inlet wherein the housing cover is attached to the blower housing to form a bottom surface of the second chamber.

2. The blower dilution air blower of claim 1 wherein the skirt comprises at least one vent slot.

3. The dilution air blower of claim 1 wherein the backplate of the impeller has at least one aperture.

4. The dilution air blower of claim 1 wherein the backplate of the impeller is distal to the motor housing.

5. The dilution air blower of claim 1 wherein the backplate of the impeller is proximal to the motor housing.

6. The dilution air blower of claim 1 wherein the blower housing further comprises a side wall having portions which define a cover shoulder for receiving the cover.

7. The dilution air blower of claim 6 wherein the cover is secured to the cover shoulder.

8. The dilution air blower of claim 6 wherein the cover shoulder is located between a top edge and a bottom edge of the side wall.

9. The dilution air blower of claim 6 wherein the skirt extends downwardly and radially from the side wall.

10. The dilution air blower of claim 1 wherein the blower housing has an elliptical shape having a first elliptical end having a first diameter and a second elliptical end having a second diamter that is smaller than the first diameter.

11. The dilution air blower of claim 10 wherein the motor housing is biased toward the first elliptical end and the outlet is biased toward the second elliptical end.

12. The dilution air blower of claim 10 wherein the skirt comprises a first skirt extending downwardly and radially from the first elliptical end and a second skirt extending downwardly from the second elliptical end.

13. The dilution air blower of claim 12 wherein the first skirt and the second skirt have a first radially extending flange and a second radially extending flange, respectively.

14. The dilution air blower of claim 1 wherein the housing further comprises portions defining an outlet that is in fluid communication with the second chamber.

15. The dilution air blower of claim 1 wherein the housing has further portions defining water pipe apertures for receiving water pipes of a water heater.

16. A dilution air blower/water heater assembly comprising:

a water heater comprising a top surface, at least one water pipe and an exhaust flue; and, a dilution air blower attached to the top surface of the hot water heater comprising:

a blower housing comprising a motor housing forming a first chamber having with at least one vent slot, an impeller housing forming a second chamber and a skirt wherein the first chamber and second chamber are in fluid communication;

a blower motor having a motor shaft and situated in the motor housing;

an impeller having a backplate wherein the impeller is secured to the motor shaft and situated in the impeller housing such that the impeller can freely rotate within the impeller housing; and, a housing cover having portions defining an inlet wherein the housing cover is attached to the blower housing to form a bottom surface of the second chamber and wherein the combination of the housing cover, the skirt and the top surface of the water heater form a third chamber which is in fluid communication with the second chamber.

17. The dilution air blower/water heater assembly of claim 16 wherein the skirt comprises at least one vent slot.

18. The dilution air blower/water heater assembly of claim 16 wherein the backplate of the impeller has at least one aperture.

19. The dilution air blower/water heater assembly of claim 16 wherein the backplate of the impeller is distal to the motor housing.

20. The dilution air blower/water heater assembly of claim 16 wherein the backplate of the impeller is proximal to the motor housing.

21. The dilution air blower/water heater assembly of claim 16 wherein the blower housing further comprises a side wall having portions which define a cover shoulder for receiving the cover.

22. The dilution air blower of claim 21 wherein the cover is secured to the cover shoulder.

23. The dilution air blower of claim 21 wherein the cover shoulder is located between a top edge and a bottom edge of the side wall.

24. The dilution air blower of claim 16 wherein the skirt extends downwardly and radially from the side wall.

25. The dilution air blower of claim 16 wherein the housing further comprises portions defining an outlet that is in fluid communication with the second chamber.

26. The dilution air blower of claim 16 wherein the housing has further portions defining water pipe apertures for receiving water pipes of a water heater.

27. A method of providing dilution air to a dilution air blower/water heater assembly comprising the steps of:

providing a hot water heater comprising a top surface, at least one water pipe and an exhaust flue;

providing a dilution air blower attached to the top surface of the water heater comprising:

a blower housing comprising a motor housing forming a first chamber having at least one vent slot, an impeller housing forming a second chamber and a skirt wherein the first chamber and second chamber are in fluid communication;

a blower motor having a motor shaft and situated in the motor housing;

an impeller having a backplate wherein the impeller is secured to the motor shaft and situated in the impeller housing such that the impeller can freely rotate within the impeller housing; and, a housing cover having portions defining an inlet wherein the housing cover is attached to the blower housing to form a bottom surface of the second chamber and wherein the combination of the housing cover, the skirt and the top surface of the water heater form a third chamber which is in fluid communication with the second chamber rotating the impeller to develop negative air pressure in the second chamber to draw air from the first and third chambers into the second chamber;

generating negative air pressure in the first and third chambers;

drawing dilution air into the first chamber via the at least one motor housing vent slot;

cooling the motor with the dilution air entering the first chamber via the at least one motor housing vent slot;

drawing the dilution air in the first chamber in to the second chamber via the at least one aperture in the impeller;

drawing exhaust gases flowing out of the exhaust flue into the second chamber via the inlet in the housing cover;

mixing the exhaust gases with the dilution air drawn into the second chamber from the first chamber to form a gas mixture; and, expelling the gas mixture from the dilution air blower via the outlet.

28. The method of claim 27 further comprising the step of securing the dilution air blower to the water heater so that the housing cover inlet is in axial alignment with a longitudinal axis of the exhaust flue.

29. The method of claim 27 further comprising the step of securing the dilution air blower to the water heater so that the housing cover inlet is not in axial alignment with a longitudinal axis of the exhaust flue.

30. The method of claim 27 further comprising the step of providing a blower housing with an elliptical shape wherein the blower housing has a first elliptical end with a first diameter and a second elliptical end having a second diameter smaller than the first diameter.

31. The method of claim 30 wherein the dilution air blower is secured to the water heater such that the inlet is biased toward the first elliptical end relative to a longitudinal axis of the exhaust flue.

32. The method of claim 27 further comprising the step of providing the skirt with at least one skirt vent slot;

drawing dilution air into the third chamber via the at least one skirt vent slot;

cooling exhaust gases flowing out of the exhaust flue with the dilution air entering the third chamber via the at least one skirt vent slot to form a gas mixture;

drawing the gas mixture into the second chamber via the inlet in the housing cover; and, mixing the gas mixture with the dilution air drawn into the second chamber from the first chamber to form a second gas mixture.

33. The method of claim 27 wherein the backplate of the impeller has at least one aperture which facilitates fluid communication between the first chamber and the second chamber.

* * * * *